US006101988A

United States Patent [19]

Evans

[11] Patent Number: 6,101,988

[45] Date of Patent: Aug. 15, 2000

[54] HERMETICALLY-SEALED ENGINE COOLING SYSTEM AND RELATED METHOD OF COOLING

[75] Inventor: John W. Evans, Sharon, Conn.

[73] Assignee: Evans Cooling Systems, Inc., Sharon, Conn.

[21] Appl. No.: 08/747,634

[22] Filed: Nov. 13, 1996

[51] Int. Cl.[7] ..... F01P 11/20

[52] U.S. Cl. ..... 123/41.5; 123/41.42; 123/41.51; 123/41.54

[58] Field of Search ..... 123/41.5, 41.51, 123/41.54, 41.42

[56] References Cited

U.S. PATENT DOCUMENTS

| | | | |
|---|---|---|---|
| 2,988,068 | 6/1961 | Waydak | 123/41.54 |
| 3,238,932 | 3/1966 | Simpson | 123/41.5 |
| 3,499,481 | 3/1970 | Avrea | 165/11 |
| 4,006,775 | 2/1977 | Avrea | 165/51 |
| 4,079,855 | 3/1978 | Avrea | 220/203 |
| 4,196,822 | 4/1980 | Avrea | 220/203 |
| 4,461,342 | 7/1984 | Avrea | 165/104 |
| 4,498,599 | 2/1985 | Avrea | 220/203 |
| 4,550,694 | 11/1985 | Evans | 123/41.02 |
| 4,630,572 | 12/1986 | Evans | 123/41.21 |
| 5,031,579 | 7/1991 | Evans | 123/41.2 |
| 5,044,430 | 9/1991 | Avrea | 123/41.51 |
| 5,172,657 | 12/1992 | Sausner et al. | 123/41.5 |
| 5,255,636 | 10/1993 | Evans | 123/41.54 |
| 5,317,994 | 6/1994 | Evans | 123/41.1 |
| 5,353,751 | 10/1994 | Evans | 123/41.01 |
| 5,381,762 | 1/1995 | Evans | 123/41.54 |
| 5,385,123 | 1/1995 | Evans | 123/41.21 |
| 5,419,287 | 5/1995 | Evans | 123/41.29 |

FOREIGN PATENT DOCUMENTS

| | | | |
|---|---|---|---|
| 3143749 | 5/1983 | Germany | 123/41.54 |

OTHER PUBLICATIONS

Chrysler Corporation, *Cooling System Service Manual for the 1996 New Yorker, LHS, Concorde, Intrepid and Vision*, pp. 7–1 through 7–4, Jul. 21 and Jul. 22, 1995.

Ford Motor Corporation, *Owner's Guide for Mercury Sable* "Engine Oil/Engine Cooling System", p. 150, 1986.

Ford Motor Corporation, *Service Manual for the Lincoln Town Car, Crown Victoria/Grand Marquis*, pp. 03–03–1 through 03–03–7, 1992.

Ford Motor Corporation, *Taurus/Sable Shop Manual* "Cooling System Group 27".

Product literature from Opti–Cap, Inc., entitled "A Typical Installation Looks Like This When Completed", regarding the OPTI–CAP®, 7 pages.

*Primary Examiner*—Noah P. Kamen
*Attorney, Agent, or Firm*—McCormick, Paulding & Huber

[57] ABSTRACT

In an engine cooling system, an upper coolant chamber and a lower coolant chamber of a typical engine, such as an internal combustion engine or fuel cell, are formed adjacent to the heat-rejecting components of the engine and are hermetically sealed to prevent exposure of coolant within the chambers to the engine's ambient atmosphere. The coolant is preferably a substantially anhydrous, boilable liquid coolant having a saturation temperature higher than that of water, and the coolant is pumped at a predetermined flow rate, and distributed through the coolant chambers so that the liquid coolant within the chambers substantially condenses the coolant vaporized by the heat-rejecting components of the engine. Thermally-expanded coolant, non-condensable gas, and trace amounts of vapor, if any, are received within a hermetically-sealed accumulator coupled in fluid communication with a relatively low-pressure area of the engine coolant chambers, and the accumulator defines at least one chamber, which may form a liquid-free space, for receiving the non-condensable gas and trace vapors. The at least one accumulator chamber defines a predetermined volume, which may be a variable volume, selected to maintain the pressure within the accumulator within a predetermined pressure limit (e.g., about 5 psig) during engine operation.

36 Claims, 6 Drawing Sheets

HERMETICALLY-SEALED ENGINE COOLING SYSTEM AND RELATED METHOD OF COOLING

FIELD OF THE INVENTION

The present invention relates generally to cooling systems for power generating equipment or engines (for example, internal combustion engines, fuel cells and the like), such as those used in motor vehicles, construction equipment, generators and other applications, and more specifically, to a hermetically-sealed, condenserless cooling system, preferably employing a substantially anhydrous, boilable liquid coolant.

BACKGROUND INFORMATION

It has long been a desire to hermetically seal cooling systems for power generating equipment, such as internal combustion engines (e.g., to positively seal the vent and fill caps), to thereby isolate the liquid coolant and the liquid-side surfaces of the engine and cooling system components from the engine's ambient atmosphere. An ideal such system would have to be truly hermetically sealed and therefore, under normal operation, would never allow the transfer of air, or moisture, into or out of the cooling system. The pressurized cooling systems currently in use represent only a partial step toward this condition because the characteristics of the aqueous-based coolants typically used in such systems do not allow for operation of the system in a hermetically-sealed condition.

With reference, as an example, to current production fuel cells and internal combustion engines, a typical aqueous-based cooling system is pressurized during operation by (i) thermal expansion of the coolant, and (ii) water vapor generated as a result of localized boiling of the coolant within the coolant chambers. These types of cooling systems must therefore be equipped with pressure-relief valves, usually mounted within the fill cap, which limit the maximum system pressure to about one atmosphere (14 to 15 psig) above ambient pressure. When the pressure-relief setting of a valve is exceeded, thermally-expanded coolant and gases or vapors within the system are purged out through the relief valve and into an overflow reservoir having a vent open to the ambient atmosphere. A recovery valve is also provided to permit the coolant in the reservoir, along with ambient air to be drawn back into the coolant chambers when the engine cools down.

In some cases the fill cap, relief valve and recovery valve are mounted on the top of a pressure-resistant overflow reservoir so that during engine operation the entire cooling system, including the reservoir, is pressurized. Thermally-expanded coolant, gases and vapors are purged into the reservoir, which raises the liquid level and in turn compresses the liquid-free space, if any, within the reservoir, and thereby raises the pressure of the entire cooling system. When the system pressure exceeds the pressure-relief valve setting, the gases, vapors, and in some instances, liquid coolant, are purged from the reservoir into the ambient atmosphere. Here again, when the engine cools down, ambient air is drawn back into the cooling system through the recovery valve.

Accordingly, both of these types of systems suffer from the recurring exchange of gases and/or vapors between the engine cooling system and ambient atmosphere during each temperature cycle of engine operation. In addition, there is the continuous problem of water loss caused when small amounts of water vapor (which in some instances includes coolant) are purged through the relief valve and into the ambient atmosphere. Gradually, as small amounts of water are continuously purged from the cooling system, the total coolant volume is reduced and the coolant mixture is changed from the desired mixture to one having a lesser concentration of water. Engine cooling systems for motor vehicles typically employ a liquid coolant which is a 50/50 mixture of ethylene glycol and water (i.e., 50% ethylene glycol and 50% water). As the water concentration in such coolant mixtures is reduced, the greater concentration of ethylene glycol causes the coolant mixture to have a lower specific heat value.

In contrast to their different freezing points, the saturation (boiling) temperature and condensation characteristics of commercially available 50/50 ethylene glycol and water (EGW) coolants are similar to those of 100% water. The saturation temperature of water is the same as its maximum condensation temperature, 100° C. (212° F.) at 0 psig, and 115° C. (239° F.) at 15 psig. Similarly, a typical 50/50 EGW mixture boils at about 107° C. (224° F.) at 0 psig, and about 124° C. (255° F.) at 15 psig. Water, however, has a much higher vapor pressure than does ethylene glycol, and thus when a 50/50 EGW mixture is boiled the vapor generated is primarily water (about 98% water by volume).

Accordingly, at each system pressure for which a 50/50 EGW coolant produces water vapor, the condensation point for the vapor generated (about 98% water) will be substantially lower than the boiling point of the 50/50 EGW coolant at which it was generated. For example, as indicated above, in a system employing a 50/50 EGW coolant at 15 psig, the water vapor that is generated at about 124° C. (255° F.) will not condense within the coolant chambers until it is entrained within liquid coolant having a bulk temperature of about 115° C. (239° F.) or less. Thus, in order to condense the water vapor, the radiator and/or other heat exchange components of the cooling system would have to establish a heat exchange rate creating a temperature differential ($\Delta T$) of about 8° C. (16° F.) across the engine. However, because motor vehicles are subjected to a variety of operating loads and/or ambient conditions, it has proven to be difficult to control typical internal combustion engines to achieve a heat-exchange rate ($\Delta T$) of more than about 4.4° to 5.5° C. (8° to 10° F.). As a result, during engine operation at high loads and/or ambient temperatures, the EGW coolant temperature frequently approaches the saturation temperature of water at the respective system pressure. The water vapor that is produced cannot therefore be condensed quickly enough to prevent it from occupying a large space within the cooling system, which in turn increases the system pressure and causes substantial volumes of gas, vapor, and in some instances coolant, to be purged through the relief valve.

In an effort to maintain the saturation and condensation temperatures of the bulk coolant relatively high, and in turn minimize the exchange of gases and/or vapors with the ambient atmosphere through the relief and recovery valves, the pressure-relief valves are typically set at about one atmosphere (14 to 15 psig) or higher in order to maintain the cooling systems at such pressures during engine operation. One of the drawbacks of these types of cooling systems, however, is that the relatively high operating pressures, and pressure cycles encountered with shifts in coolant temperatures, place undesirable internal load conditions upon the components of the cooling system (i.e., the radiator, hoses, heater core, clamps, valves, gaskets, etc.), which can in turn lead to leaks and other problems causing system failure.

Another problem encountered with such systems is that the coolant is exposed to relative high amounts of oxygen in the engine's ambient atmosphere. The introduction of oxygen into the coolant causes an increasing rate of oxidation of the coolant, and in the production of acids (oxsolic, acetic, etc.) and thus significantly limits the effective useful life of the coolant additives. This is discussed in further detail in my co-pending application Ser. No. 08/449,338, entitled "A Method Of Cooling A Heat Exchange System Using A Non-Aqueous Heat Transfer Fluid", which is hereby expressly incorporated by reference as part of the present disclosure.

My U.S. Pat. No. 5,031,579, dated Jul. 16, 1991, which is hereby expressly incorporated by reference as part of the present disclosure, shows a condenserless apparatus for cooling an internal combustion engine with a substantially anhydrous, boilable liquid coolant having a saturation temperature above that of water. The apparatus comprises a coolant chamber surrounding the cylinder walls and combustion chamber domes of the engine, and a coolant pump which is adapted to pump coolant through the coolant chamber at a flow rate so that the liquid coolant substantially condenses the coolant vaporized upon contact with the metal surfaces of the engine.

The apparatus of the '579 patent further comprises means for exhausting gases and/or vapors from the coolant chamber which is coupled in fluid communication with the chamber at a location at or below ambient pressure. The means for exhausting preferably includes a conduit coupled on end to the coolant chamber, and an expansion tank coupled to the other end of the conduit for receiving the gases and/or vapors from the coolant chamber and purging the gases through an outlet port into the ambient atmosphere. The liquid within the expansion tank is maintained at a level above the tank's connection to the conduit in order to provide a liquid barrier between the coolant chamber and the engine's ambient atmosphere.

The apparatus of the '579 patent further comprises a dehydrating unit coupled in fluid communication with an outlet port of the expansion tank for dehydrating the ambient air drawn into the expansion tank and thereby minimizing the exposure of the coolant to ambient vapors. Thus, an engine equipped with this type of apparatus can limit the amount of moisture returning to the coolant chamber by employing both the liquid barrier in the expansion tank and the dehydrating unit. The high vapor pressure of water will cause any water in the expansion tank to vaporize at higher ambient temperatures (above about 32.2° C. or 90° F.) typically stabilizing at a water content of about 2% to 5%, and the dehydrating unit will in turn maintain the coolant at a lower moisture level (about 1% to 2%) during its effective life.

The apparatus of the '579 patent can use substantially non-aqueous coolants operating at ambient vent pressures, and therefore derives significant benefits over currently produced engine cooling systems. However, although the dehydrating unit provides significant advantages, it may be perceived in certain applications as being relatively bulky and thus undesirable. In addition, even when the engine is not running, the dehydrating unit will continue to absorb moisture, and thus requires periodic maintenance to remain effective. The preferred coolants in the apparatus of the '579 patent are forms of diols (e.g., propylene glycol) and are basically hygrascopis such that if exposed, they will continue to absorb water vapor. If the dehydrating unit becomes saturated, it will permit moisture to pass into the expansion tank and in turn expose the coolant to undesirable levels of moisture. Thus, particularly at low ambient temperatures (e.g., below about 10° C. or 50° F.) the liquid barrier in the expansion tank will not function to completely prevent the introduction of water vapor into the engine coolant chamber, but rather will absorb a certain amount of moisture. In addition, the thermally-expanded coolant received in the expansion tank would be exposed to the ambient atmosphere and higher levels of oxygen, thus increasing the oxidation rate of the coolant, and in turn limiting the effective life of the coolant additives, as described above.

Accordingly, it is an object of the present invention to overcome the drawbacks and disadvantages of the above-described cooling systems for internal combustion engines and other power generating equipment.

SUMMARY OF THE INVENTION

The present invention is directed to a hermetically-sealed engine cooling system, and a related method of cooling, wherein at least one engine coolant chamber, such as the head coolant chamber and block coolant chamber in a typical internal combustion engine, are formed adjacent to the heat-rejecting components of the engine and are hermetically sealed to prevent exposure of coolant within the chambers to the engine's ambient atmosphere. The coolant is preferably a substantially anhydrous, boilable liquid coolant having a saturation temperature higher than that of water, and the coolant is pumped at a predetermined flow rate, and distributed through the engine coolant chambers so that the liquid coolant within the chambers condenses any coolant vaporized by the heat-rejecting components of the engine. Thermally-expanded coolant, and non-condensable gases and trace amounts of vapor, if any, are received within a hermetically-sealed accumulator coupled in fluid communication with the engine coolant chambers. The accumulator defines at least one chamber for receiving at least one of thermally-expanded coolant, and non-condensable gases and trace vapors, if any, and the chamber defines a predetermined volume selected to maintain the pressure within the accumulator, and thus the "static" or "base" pressure within the engine coolant chambers within a predetermined pressure limit during engine operation. The volume of the at least one accumulator chamber may be selected in order to achieve any desired pressure limit; however, in the preferred embodiments of the present invention, the predetermined pressure limit is less than about 5 psig, and in some instances the pressure limit is approximately equal to the pressure of the engine's ambient atmosphere (about 0 psig).

In one embodiment of the present invention, the accumulator includes (i) a first chamber coupled in fluid communication with the coolant chambers and defining a first volume for receiving thermally-expanded coolant during engine operation, and (ii) a second chamber coupled in fluid communication with the first chamber and forming a liquid-free space for receiving the non-condensable gases and trace vapors, if any. The volume of the second chamber is preferably within the range of approximately 2.0 to 3.0 times greater than the volume of the first chamber. The accumulator preferably also defines a third chamber coupled in fluid communication between the engine coolant chambers and the first chamber, and which contains a predetermined volume of liquid coolant forming a liquid barrier between the second chamber and engine coolant chambers.

The at least one chamber of the accumulator may be adapted to expand in response to the introduction of at least one of coolant and gases into the chamber in order to define the predetermined volume selected to maintain the pressure of the accumulator and engine coolant chambers within a predetermined pressure limit. In one embodiment of the invention, the expandable chamber is defined by an expandable wall section which is expandable in at least one direction in response to the introduction of at least one of coolant and gases into the chamber. In another embodiment of the invention, the expandable chamber is defined by a movable wall section slidably received within the expandable chamber, and movable to expand the volume of the chamber in response to the introduction of at least one of coolant and gases into the chamber.

One advantage of the present invention is that the operating pressure within the coolant chambers is always maintained below a predetermined pressure limit, and the coolant chambers and accumulator are maintained in a hermetically-sealed condition during normal engine operation. Accordingly, there is no exposure of the coolant to the engine's ambient atmosphere, thus eliminating the possibility of ambient vapors or gases being introduced into the cooling system, and preventing exposure of the coolant to the relatively high levels of oxygen in the ambient atmosphere. In addition, the engine cooling system of the invention is configured to operate at relatively low static pressures (e.g., less than about 5 psig), and thus the problems associated with relatively high operating pressures in prior art aqueous-based cooling systems are substantially avoided.

Another advantage of the present invention is that there is no need for a condenser mounted above the engine. Rather, the coolant is pumped and distributed through the engine so that the liquid coolant substantially condenses the coolant vaporized upon contact with the metal surfaces of the engine. Yet another advantage is that when a preferred, substantially anhydrous coolant is employed, the engine can be operated with bulk coolant temperatures above 100° C. (212° F.), without producing large amounts of vapor, as would occur in prior art aqueous-based cooling systems. Rather, expansion within the engine cooling system is limited to thermal expansion of the coolant during engine operation, which can be accommodated by the hermetically-sealed accumulator at relatively low operating pressures.

Other advantages of the present invention will become apparent in view of the following detailed description and accompanying drawings.

DETAILED DESCRIPTION OF PREFERRED EMBODIMENTS

Figure 1:
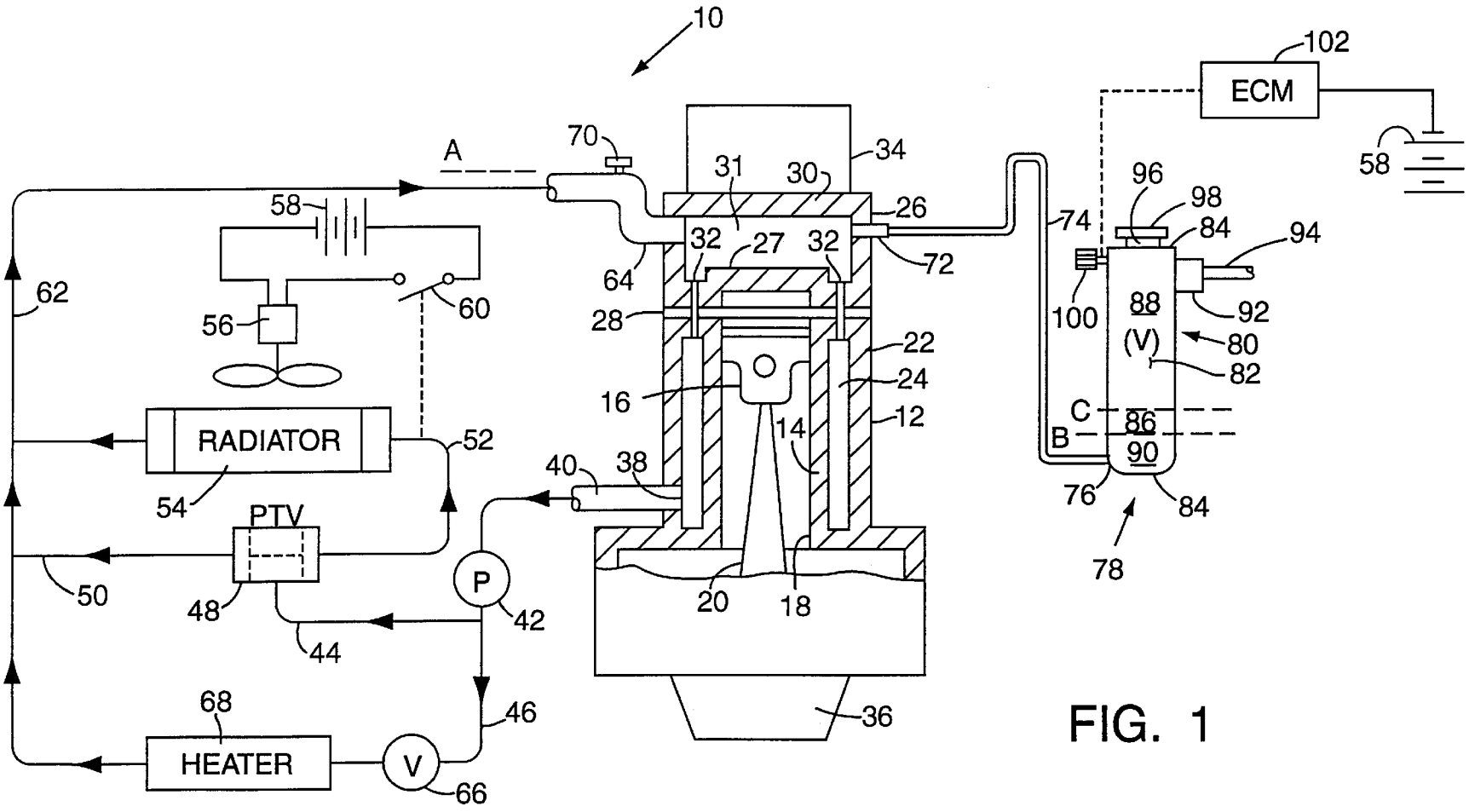
FIG. 1 is a schematic, partial cross-sectional view of a first embodiment of an engine cooling system of the present invention comprising an accumulator defining a liquid-free space having a fixed volume for receiving thermally-expanded coolant, and non-condensable gases and trace amounts of vapor, if any.

In FIG. 1, a typical internal combustion engine comprising a cooling system embodying the invention, and configured to operate in accordance with the method of the invention, is indicated generally by the reference numeral 10. Although the preferred embodiments of the present invention are described herein with reference to several known types of engines or power-generating apparatus, including internal combustion engines and fuel cells, as will be recognized by those skilled in the pertinent art, the present invention is equally applicable to numerous other types of engines or power-generating apparatus. Accordingly, unless specifically indicated otherwise, the terms "engine" and "power-generating apparatus" are used interchangeably in this specification, and each of these terms is intended to include, without limitation, any of numerous different types of apparatus for converting any of various forms of energy into mechanical force or motion, or for converting one form of energy into another, such as the conversion of fuel into electricity.

The engine 10 comprises an engine block 12 which has formed therein several cylinder walls 14. Each cylinder wall 14 defines a cylinder bore 18, and a respective piston 16 is slidably received within each cylinder bore. Each piston 16 is coupled to a connecting rod 20, and each connecting rod is in turn coupled to a crank shaft (not shown) for converting the reciprocating motion of the pistons to rotary motion for driving the vehicle.

A block coolant jacket 22 surrounds the cylinder walls 14, and is spaced from the cylinder walls, thus defining a hermetically-sealed block coolant chamber 24 for receiving a liquid coolant to transfer heat away from the heat-generating components of the engine. The preferred coolant used in the system of the present invention is a substantially anhydrous, boilable liquid coolant having a saturation temperature higher than that of water. One such coolant is propylene glycol with additives to inhibit corrosion, as described in the above-mentioned co-pending patent application.

The coolants used in the system of the present invention are also preferably organic liquids, some of which are miscible with water and others which are substantially immiscible with water. The coolants that are miscible with water can tolerate a small amount of water. However, the performance of the system of the present invention is enhanced by maintaining the water content at a minimum level, preferably less than about 3%. Suitable coolant constituents that are miscible with water include propylene glycol, ethylene glycol, tetrahydrofurfuryl alcohol, and dipropylene glycol. Coolants that are immiscible with water might contain trace amounts of water as an impurity, usually less than one percent (by weight). Suitable coolant constituents that are substantially immiscible with water include 2, 2, 4-trimethyl-1, 3-pentanediol monoisobutyrate, dibutyl isopropanolamine and 2-butyl octanol. All of these preferred coolant constituents have vapor pressures substantially less than that of water at any given temperature, and have saturation temperatures above about 132° C. at atmospheric pressure.

A cylinder head 26 is mounted to the engine block 12 above the cylinder walls 14. The cylinder head 26 defines a combustion chamber dome 27 above each cylinder bore 18, and a combustion chamber is thus defined between each piston and combustion chamber dome. A head gasket 28 is seated between the cylinder head 26 and the engine block 12, and the cylinder head includes a head coolant jacket 30 defining a head coolant chamber 31 for receiving the liquid coolant to transfer heat primarily from the combustion chamber domes and other heat-generating components of the head. The head gasket 28 hermetically seals the combustion chambers from the coolant chambers and, likewise, hermetically seals the coolant chambers from the exterior of the engine (or the engine's ambient atmosphere).

A plurality of coolant ports 32 extend through the base of the cylinder head 26, through the head gasket 28, and through the top of the block coolant jacket 22. The engine coolant can thus flow either from the head coolant chamber 31, through the coolant ports 32, and into the block coolant chamber 24 (currently referred to as a "reverse-flow" configuration), or in the opposite direction (currently referred to as a "conventional-flow" configuration). The currently preferred direction, however, is from the head coolant chamber 31 into the block coolant chamber 24, as described in U.S. Pat. No. 5,031,579.

The engine 10 further comprises a valve cover 34 mounted on top of the cylinder head 26, and an oil pan 36 mounted to the bottom of the block 12 to hold the engine's oil. An oil cooling system (not shown), known to those skilled in the pertinent art, can be employed to maintain the engine oil temperature below a certain level. For example, an air-to-oil or liquid-to-oil system may be employed.

A coolant outlet port 38 extends through a bottom wall of the coolant jacket 22, and is in fluid communication with the coolant chamber 24. A first coolant line 40 is coupled on one end to the coolant outlet port 38 and coupled on the other end to the inlet port of a pump 42. The outlet port of the pump 42 is coupled to a second coolant line 44 and a third coolant line 46.

As described in further detail in U.S. Pat. No. 5,031,579, the size of the pump 42 is selected to achieve the coolant flow rates required under different operating loads, and the distribution of the coolant flow through the coolant chambers is selected in order to promptly condense within the bulk coolant any coolant vapor generated upon contact with the hotter metal surfaces of the engine. In the preferred reverse-flow configuration, the engine 10 preferably includes a "rear-flow" head gasket 28 with coolant ports 32 which are located in order to distribute the coolant along the following path: from the front of the head coolant chamber 31 to the rear of the chamber; down through the coolant ports 32 and into the rear of the block coolant chamber 24; and then from the rear of the block coolant chamber 24 to the front of the chamber, where the coolant is discharged through the first coolant line 40. In an exemplary 350 cubic inch (5.7 L), V-8 engine constructed in accordance with the present invention and having a rear-flow head gasket, the pump 42 was selected to pump the coolant at a flow rate of about 63 gallons per minute ("GPM") at an engine speed of about 5,200 revolutions per minute ("RPM"). The bulk coolant temperature was typically about 100° C. (212° F.), and the rate at which heat was transferred to the coolant was typically about 5000 BTU/min.

If it is necessary to maintain the bulk coolant at a specific temperature, then the second coolant line 44 may be connected to a proportional thermostatic valve (PTV) 48. The PTV 48 is in turn connected to a bypass line 50 and a radiator line 52, and is set to detect a threshold temperature of the coolant flowing through the second coolant line 44. If the temperature of the coolant is below the threshold, then depending upon the level of the temperature, the PTV 48 directs a proportional amount of coolant through the bypass line 50. If, on the other hand, the coolant temperature is above the threshold, then the PTV 48 directs the coolant into the radiator line 52. If the coolant temperature need not be controlled to a specific value, then the PTV 48 and associated connecting lines may be eliminated.

The other end of the radiator line 52 is coupled to a radiator 54, and an electric fan 56 is mounted in front of the radiator and is powered by a vehicle battery 58. The fan 56 is controlled by a thermostatic switch 60 which is in turn connected to the radiator line 52. Depending upon the temperature of the coolant in the radiator line 52, the thermostatic switch 60 operates the fan 56 to increase the airflow through radiator 54, and thus increase the rate of heat exchange with the hot coolant. Here again the fan may be eliminated if not required for temperature control, or alternatively, the fan may be mechanically driven.

Both the output of the radiator 54 and the other end of the bypass line 50 are connected to an engine input line 62. The input line 62 is in turn connected to an input port 64 extending through a top wall of the cylinder head 26. Thus, depending upon the temperature of the coolant flowing through the second coolant line 44, the coolant flows either through the bypass line 50 or the radiator 54, which are both in turn connected to the input line 62. During engine warm-up, for example, when the coolant temperature is relatively low, the coolant is directed by the PTV 48 through the bypass line 50. However, once the engine is warmed up, at least some of the coolant is usually directed through the radiator 54. The lower temperature coolant flowing through the input line 62 flows through the input port 64 and back into the cylinder head coolant chamber 31.

The style of radiator 54 can be any of a number of radiator styles available to those of ordinary skill in the pertinent art (e.g., cross-flow, down-flow, etc.). However, the construction of the radiator 54 is selected to specifically accommodate the coolant flow rates determined in accordance with the present invention. In one embodiment of the invention, wherein the engine is a 350 cubic inch (5.7 L) V-8, the radiator 54 has a parallel-finned tube construction with the following approximate dimensions: 394 mm high; 610 mm wide; 69.9 mm thick; and a substantially constant wall thickness of about 2.8 mm. The radiator is made of aluminum and has two rows of tubes with thirty-eight tubes in each row. Each tube has a substantially oval cross-sectional shape and is about 25.5 mm to 32 mm wide, by about 2.3 mm high (i.d.), and 518 mm long. The radiator 54 can be made of aluminum or other suitable material which will not be corroded or otherwise damaged by the coolants used in accordance with the present invention.

It should be noted that the radiator 54 is not required to retain gases, as with most known systems, and therefore does not have to be positioned above the highest level of coolant. The shape of the radiator can also be unique. For example, it may be curved or made relatively low and with greater horizontal depth in comparison to radiators for water-based coolant systems, to accommodate, for example, an aerodynamic-shaped vehicle.

As also shown in FIG. 1, if necessary, a passenger compartment heater 68 may be connected between the third coolant line 46 and the engine input line 62. The heater 68 is mounted on the vehicle to heat its interior compartment by heat exchange with the hot coolant. A valve 66 is mounted within the third coolant line 46 to control the flow of coolant to the heater. If the valve 66 is closed, then the coolant discharged by the pump 42 flows into the second coolant line 44. Otherwise, depending upon the degree to which the valve 66 is opened, a portion of the hot coolant flows through the heater 68. The coolant discharged by the heater 68 flows through the engine input line 62, and back into the head coolant chamber 31.

It is often found desirable to mount an air-bleed valve 70 within the input line 62 above the engine input port 64. The air-bleed valve 70 is located at or above the highest coolant level in the engine, which is indicated by the dotted line A in FIG. 1. The air-bleed valve 70 is provided to bleed air or other gases or vapors from the engine cooling system when it is being filled with coolant.

A vent port 72 extends through an upper portion of the cylinder head 26, and is connected to a vent line 74 of an accumulator 78 in order to exhaust expanded liquid coolant and gases from the engine coolant chambers into the vent line of the accumulator. The vent port 72 may be connected to any relatively low-pressure area on the draw side of the pump 42 and radiator 54 within the cooling circuit in order to effectively exhaust the expanded coolant and vapors. However, in order to substantially completely exhaust any non-condensable gases (e.g., gases introduced into the cooling system when filling the system with coolant, or due to a combustion gasket leak) and trace vapors, the preferred location for the vent port is within the upper region of the highest coolant chamber 31, as shown.

The vent line 74 is in turn connected to an inlet port 76 of the accumulator 78. The accumulator 78 forms at least one hermetically-sealed chamber for receiving thermally-expanded coolant and non-condensable gases and trace amounts of vapor, if any, from the engine coolant chambers, and the at least one chamber defines a predetermined volume selected to maintain the pressure within the accumulator, and thus the static pressure of the engine coolant chambers below a predetermined pressure limit during normal engine operation. In the embodiment of the present invention illustrated, the predetermined pressure limit is approximately four (4) psig. However, as will be recognized by those skilled in the pertinent art, the volume of the at least one hermetically-sealed chamber may be adjusted to achieve any desired predetermined pressure limit during normal engine operation.

The accumulator 78 includes a hollow housing 80 defined by a cylindrical, rigid side wall 82, and two rigid end walls 84. As shown in FIG. 1, the hollow interior of the accumulator housing 80 defines a cold coolant level "B" and a hot coolant level "C"; and the inlet port 76 is preferably located in the base portion of the housing below the cold coolant level B, in order to maintain a liquid barrier between the interior of the accumulator and head coolant chamber 31.

The hollow interior of the accumulator housing 80 thus defines three hermetically-sealed chambers coupled in fluid communication with the engine coolant chambers: (i) a first chamber 86 for receiving thermally-expanded coolant during engine operation, and defined by the space between the cold coolant level "B" and hot coolant level "C"; (ii) a second chamber 88 defined by the liquid-free space above the coolant level in the first chamber 86 for receiving non-condensable gases and trace amounts of vapor, if any, during normal engine operation, and defining a volume "V" which is selected to maintain the pressure in the accumulator, and thus the static pressure in the engine coolant chambers within a predetermined pressure limit during normal engine operation; and (iii) a third chamber 90 located below the first chamber 86 for receiving liquid coolant and forming a liquid barrier between the other chambers of the accumulator and the engine coolant chambers. Accordingly, the accumulator 78 permits the engine cooling system of the invention to be operated in a totally hermetically-sealed condition, at a relatively low pressure (preferably no greater than about ⅓ atmosphere or 4 psig) with no exposure of coolant to the engine's ambient atmosphere, as is described in further detail below.

Unless specifically indicated otherwise, the term "chamber" is used in this specification to mean an enclosed, or partially enclosed space or area defining a fixed, variable or expandable volume for receiving fluids and/or gases. As illustrated by the chambers 86, 88 and 90 of the accumulator 78, each chamber may define a respective portion of an enclosed space or larger chamber without any wall or other physical medium separating adjacent chambers. Alternatively, one or more of the chambers may be further defined by a respective container, or a wall or like medium separating one chamber from another, as illustrated in other exemplary embodiments of the invention described below.

The vent line 74 normally carries primarily expanded coolant during engine warm-up; and otherwise infrequent and insubstantial amounts of non-condensable gases (and trace amounts of coolant or water vapor, if they exist). The non-condensable gases typically become entrained within the coolant when the system is initially filled with coolant or due to leaks (e.g., head gasket leaks). The accumulator 78 is therefore normally required to handle only the gradual passage of small amounts of coolant expanded by temperature variations within the engine cooling system (primarily during engine warm-up from cold start to operating temperature). During the complete time period of the full warm-up cycle, the total volume of thermally-expanded coolant received in the accumulator 78 is typically about 4% to 6% of the total coolant volume. The vent line 74 may therefore define a relatively small internal diameter, typically about ¼ to 5/16 of an inch, without creating significant flow restriction or back pressure. Additionally, as explained below, the housing 80 of the accumulator can likewise be relatively small, without creating a resultant high operating pressure within the cooling system, while at all times remaining hermetically sealed to thereby prevent exposure of the coolant to the engine's ambient atmosphere.

In some instances, the third chamber 90 for receiving the liquid barrier could be formed by the vent line 74 whereby the housing 80 of the accumulator would form only the first chamber 86 for receiving expanded coolant and the second chamber 88 for receiving non-condensable gases and trace vapors, if any. Alternatively, the vent line 74 could define both the first chamber 86 and third chamber 90 for receiving both the liquid barrier and expanded coolant, and the housing 80 of the accumulator would in turn define only the second chamber 88 for receiving non-condensable gases and trace vapors, if any. In each of these instances, the vent line 74 would have to define a sufficient internal volume for forming one or both chambers. This could be achieved, for example, by forming the vent line with a relatively large internal diameter (e.g., approximately 0.75 inch (1.9 cm) or greater). Alternatively, this may be desirable in applications where the accumulator housing 80 is spaced at such a distance from the vent port that a relatively lengthy vent line, defining a relatively large internal capacity, is required. In each of these instances, the vent line 74 would establish a "cold fill" coolant level approximately the same as the coolant level "A" of FIG. 1. Typically, the cold fill coolant level of the vent line would be located between the vent port and the top of the "high loop" of the vent line (shown typically by the U-shaped portion of the vent line 74 in FIG. 1).

In order to accommodate the possibility of an abnormal condition in which excessive amounts of gases might flow into the accumulator 78 (e.g., due to a severe head gasket leak, or if a substantial amount of water is introduced into the coolant), a safety valve 92 is mounted in the upper portion of the housing 80 and coupled in fluid communication between the second chamber 88 and an exhaust line 94. The safety valve 92 is a one-way valve which is normally closed to maintain the hollow interior of the accumulator hermetically sealed, but is configured to automatically open when the pressure within the accumulator exceeds a threshold value to thereby purge the pressurized gases or vapors from the second chamber 88 through the exhaust line 94 and into the engine's ambient atmosphere. The pressure setting of the safety valve 92 is typically set at a pressure point several pounds above the practical operating pressure of the system. The safety valve 92 is required only if there is a major failure in the nature of a combustion leak (i.e., due to a failed head gasket), or if a major fraction of water is introduced into the coolant mixture, such that large volumes of combustion gases or water vapor are created within the coolant chambers, and the pressure within the coolant chambers exceeds the setting of the safety valve. By locating the safety valve 92 in the upper portion of the accumulator, primarily only non-condensable gases and/or vapors will be released through the valve, unless the failure is so severe that liquid coolant is forced into the normally liquid-free space 88 of the accumulator.

The accumulator 78 also includes a fill neck 96 defining a fill opening extending through the upper wall 84 for filling the system with coolant, and a fill cap 98 including a gasket (not shown) to seal the interface between the cap and neck. The fill cap 98 is preferably "cam" latched, threadedly attached, or otherwise removably secured to the fill neck to maintain the hollow interior of the accumulator in a hermetically-sealed condition. If desired, the relief valve 92 and exhaust line 94 may be mounted within the combined fill cap 98 and fill neck 96 in a manner known to those of ordinary skill in the pertinent art.

As indicated above, in the preferred operation of the engine 10, the coolant flows in the direction from the head coolant chamber 31 into the engine block coolant chamber 24. The coolant flow rate through the pump 42 and flow distribution is determined in the manner disclosed in U.S. Pat. No. 5,031,579 so that when some of the coolant does vaporize upon contact with the hotter metal surfaces of the engine, the vaporized coolant is condensed by the lower temperature coolant in the coolant chambers before the vapor reaches the vent port 72.

Propylene glycol has an atmospheric saturation temperature of about 369° F. (187° C.) and a pour point of about −57° C. (−70° F.). Therefore, with propylene glycol, the bulk of the coolant can be maintained up to a temperature as high as about 340° F. (160° C.) without pump cavitation. However, a more preferable peak operating temperature is about 250° F. (120° C.). The greater the difference between the saturation temperature and the bulk coolant temperature, the greater is the ability of the bulk coolant to condense the vaporized coolant within the coolant chambers. Although in some instances the coolant temperature in the system of the present invention might be intentionally operated substantially higher than that of a system using conventional coolants, such as a 50/50 EGW coolant mixture, the cooling system of the invention remains effective because the conditions required for "nucleate boiling" are maintained during severe or "hot" engine operating conditions.

Nucleate boiling occurs when the layer of coolant which is in direct contact with metal surfaces is heated to a temperature beyond the boiling point of the coolant. The engine's heat transfer to coolant, increased by nucleate boiling, is greatest at the junction of the above-mentioned coolant layer between the metal surfaces and the turbulent (flow induced) or agitated (boiling induced) coolant. In the phase change from liquid to vapor (nucleate boiling), the coolant vapor carries a considerably greater amount of heat than does liquid phase heat transfer. The vapor bubbles generated upon boiling the coolant when breaking away from the engine's surfaces draw new liquid coolant into contact with these surfaces to replace the vaporized coolant. Therefore, under conditions of ideal nucleate boiling, critical engine metal temperatures are maintained by the boiling point of the coolant.

"Vapor blanketing" occurs if the liquid coolant is displaced from contact with the metal surfaces of the engine by a vapor layer caused by surface boiling and vapor accumulation on these surfaces. Vapor blanketing causes the metal surfaces to become insulated from the coolant, interrupting the heat transfer and, therefore, permitting a sharp increase in metal temperature. Hot spots develop across the combustion dome and then initially moderate spark knock occurs, and later severe knocking occurs as the vapor blanketing persists.

The system of the present invention overcomes this problem by distributing the coolant through the engine coolant chambers in a predetermined manner, and by pumping the coolant at a flow rate selected to maintain nucleate boiling conditions on engine surface areas that undergo a substantial heat flux (e.g., the cylinder head combustion domes), as described in U.S. Pat. No. 5,031,579. In addition, the preferred, and relatively low predetermined pressure limit of the accumulator 78 (about 4 psig) maintains the boiling point of the coolant at a relatively low level to facilitate nucleate boiling and thereby maintain relatively low critical engine temperatures.

As mentioned above, the housing 80 of the accumulator 78, which is typically constructed substantially of rigid plastic or metal, can be relatively small, without creating a resultant high system operating pressure, while at all times hermetically-sealing the coolant from the engine's ambient atmosphere. This is accomplished by selecting the volume "V" of the second chamber 88 (or "liquid-free space" of the accumulator) so that it is about 2.0 to 3.0 times greater than the increase in coolant volume due to thermal expansion during engine operation (which is approximately equal to the volume of the first chamber 86, defined by the space between the cold coolant level "B" and hot coolant level "C"). By selecting the volume "V" of the second chamber 88 in this manner, the "hot" operating pressure of the accumulator, and thus of the hermetically-sealed engine cooling system, will be between about 3 to 5 psig. This relatively insignificant increase in system pressure is caused by the thermal expansion of the coolant, and the resultant compression of the liquid-free space defined by the chamber 88 of the accumulator. The static pressure of the engine cooling system will remain fixed and stable for each operating temperature of the engine (and coolant) regardless of the particular engine load, RPM, or BTUs of heat rejected to coolant.

Because the coolant vapor produced at any given engine load or condition is promptly condensed by the bulk coolant within the coolant chambers, there is little, if any, entrained vapor persisting within the system, and as a result, there is essentially no accumulation of vapor, or variation of the amount of vapor within the system, thus stabilizing the volume of thermally-expanded coolant and the operating pressure of the system. Coolant expansion is therefore due substantially entirely to the liquid's thermal expansion, which is predictable and relatively constant at each engine operating temperature.

If the cooling capacity of the radiator is inadequate to stabilize engine temperature to a selected thermostat setting at a given engine load and ambient temperature, then the bulk coolant will increase in temperature to a higher stabilized point for each engine operating load and ambient temperature, and the resultant thermal-expansion of coolant will cause its volume to increase to a stabilized level for the respective higher coolant temperature. At each stabilized point, the coolant volume will remain constant (without the accumulation of entrained, transient coolant vapor) and the system pressure will correspondingly increase with coolant expansion to a stabilized level at each stabilized temperature point.

The following table summarizes the typical volumes and resultant pressures which were observed in a test vehicle using the cooling system of the type illustrated in FIG. 1 incorporated within a typical internal combustion engine:

Table

Engine type: V-6, turbo-charged (230 c.i., 3.8 L)

Load: 250 HP

RPM: 5000

Coolant operating temperature: 225° F.

Coolant capacity: 3.5 Gals (448 oz)

Expansion at 220° F.: 6% (28.8 oz)

Liquid-free space of accumulator: about 2.5 times expansion (67.2 oz, 0.988 L)

Operating pressure: 3.0 psig

In the construction of the test vehicle system, the housing 80 of the accumulator defined a cylindrical construction as shown in FIG. 1 and was approximately 3 inches in diameter by approximately 14 inches long (i.e., in its axial or elongated direction). This accumulator was easily installed in the engine compartment or under-hood area of the test vehicle, and was functional when mounted in various positions, including the position illustrated in FIG. 1 with the axis of the housing 80 oriented at approximately 90° relative to the horizontal, and alternately, in a position with the axis oriented at approximately 20° relative to the horizontal.

As will be recognized by those skilled in the pertinent art, the accumulator of the invention may take any of numerous different shapes and dimensions provided that the at least one hermetically-sealed chamber defines a volume "V" sufficient to maintain the pressure within the accumulator below the predetermined pressure limit (i.e., in the preferred construction, the volume "V" is at least about 2.0 to 3.0 times the expected increase in coolant volume due to thermal expansion during engine operation). Similarly, as the volume of the cooling system is increased, the volume of the accumulator 78 (and thus the volume "V" of the second chamber 88) will necessarily be correspondingly increased in order to maintain the predetermined and relatively low system pressure during engine operation. Typically, the volume of the accumulator 78 (and the volume "V" of the second chamber 88) will increase in direct proportion to the increase in coolant volume. For example, if the volume of the referenced system were increased from 3.5 gallons to 4.5 gallons of coolant (an approximately 25% increase in volume), then the total volume of the accumulator would be increased to approximately 84.0 oz (2.48 L).

One of the advantages of the cooling system of the invention is that any non-condensable gases, such as air or other gases introduced into the coolant chambers (e.g., gases trapped when filling the system with coolant, or resulting from a leak in a combustion gasket), are separated from the coolant and stored in the second chamber 88 of the accumulator. More specifically, during operation of the engine 10, any such gases will flow from the coolant chambers 24 and 31, through the vent line 74 and into the accumulator housing 80, and will rise through the liquid barrier and into the second chamber 88 of the accumulator.

The accumulator 78 preferably further includes means for periodically exhausting such gases, including a ventilation valve 100 mounted in the upper portion of the accumulator housing 80 and in fluid communication with the second chamber 88. The ventilation valve 100 is normally closed to maintain the hollow interior of the accumulator hermetically sealed, but may be opened to purge any gases from the accumulator through the valve and into the engine's ambient atmosphere. Accordingly, the ventilation valve 100 may be a manual valve (e.g., a hand-screw type valve) permitting manual operation, or alternatively, may be an electrical valve which, as shown in FIG. 1, is electrically connected to an engine control module (ECM) 102.

The gases are purged from the accumulator when the engine is cold by either manually opening the ventilation valve 100, or by programming the ECM 102 to momentarily open the ventilation valve. As an example, the ECM 102 may be programmed to momentarily open the ventilation valve during each engine start up if the measured temperature of the coolant is below a predetermined threshold value. The threshold temperature is one at which there is an insubstantial thermal expansion of coolant such that the liquid coolant level in the accumulator is approximately at the cold level "B". In the embodiment of the present invention illustrated, the threshold temperature was selected to be approximately 90° F. (32° C.). If a manual ventilation valve is employed, an operator may momentarily open the valve under the same "cold" engine conditions. In addition, the manual ventilation valve may be mounted within the fill cap 98 in a manner known to those of ordinary skill in the pertinent art.

If there are any excess gases (e.g., due to combustion leaks) contained within the second chamber 88, then the pressure within the accumulator will rapidly force such gases through the ventilation valve when momentarily opened, and the pressure within the accumulator and engine cooling system will return to approximately 0.0 psig. Under normal operating conditions, the cooling system should require purging through the ventilation valve 100 only after the system is filled (or topped off) with coolant during which process air can become trapped within the hermetically-sealed system. In these situations, the cooling system may require several "purgings", typically in between engine operating cycles, in order to purge all such trapped gases from the system. Combustion gasket leaks are not a normal operating characteristic of, nor are they otherwise typically expected in motor vehicles currently being manufactured, and therefore if repeated purging is required after an initial purge cycle, this would be indicative of a gasket leak or other defect requiring repair. A fail-safe system whereby an operator is alerted to the existence of such defects causing excessive pressure within the accumulator is described in detail below with reference to FIG. 3.

Another advantage of the present invention is that the accumulator 78 may be mounted in a convenient location on the vehicle which, if desired, may be remote from the engine 10. There is no need for the accumulator 78 to be located either near the engine 10 or above the highest coolant level "A", as is frequently required for conventional expansion tanks or condensers in other engine cooling systems. However, as shown in FIG. 1, the vent line 74 may in some instances define a U-shaped section extending above the highest coolant level "A". Any water vapor or non-condensable gases that do rise through the head coolant chamber 31 will pass through the vent line 74 and into the accumulator housing 80, as described previously.

The U-shaped section of the vent line 74 also allows for "cold system" inspection when the accumulator 78 is mounted below the highest level of coolant "A". In this situation, the fill cap 98 may be removed, and the hollow interior of the accumulator may be visually inspected without causing gravitational loss of coolant through the fill opening. In addition, if the vent line 74 defines a relatively small internal diameter as described above (e.g., about ¼ to 5/16 of an inch) and the U-shaped section of the vent line is located at a sufficient height above the maximum coolant level "A", then syphonic action or "coolant drain down" will not occur when the fill cap 98 is removed for inspection. However, if the fill cap 98 is intended to never be removed, or if there is no fill cap (or other access port on the accumulator), then the U-shaped section of the vent line 74 may be eliminated while still allowing for the accumulator to be mounted low, or at any elevation in relation to the maximum coolant level "A". Alternatively, if the accumulator 78 is mounted relatively high on the vehicle so that the inlet port 76 is located above the maximum coolant level "A", then the U-shaped section of the vent line 74 may likewise be eliminated.

Another advantage of the cooling system of the present invention is that there is no need for a condenser mounted above the engine to condense vaporized coolant. Instead, because of the coolant flow rate and distribution, the vaporized coolant is condensed within either the head coolant jacket 30, or the block coolant jacket 22 by the liquid coolant. In the hotter regions of the cylinder head 26, such as over the combustion chamber domes 27, or around the exhaust runners, some coolant inevitably vaporizes, in the form of nucleate boiling, under all operating conditions. However, by employing the system of the present invention, substantially all of the coolant is maintained at a temperature significantly below its saturation temperature. Therefore, substantially all of the vapor formed in the hot regions will condense in the liquid coolant within the coolant chambers. The present invention thus provides a hermetically-sealed, condenserless cooling system.

Moreover, the flow rate and distribution of coolant in the present invention makes the flow relatively turbulent in comparison to typical water-based coolant systems. The turbulent flow agitates the coolant vapor on the metal surfaces of the engine and thus typically increases the rate of heat exchange between the vapor and liquid coolant, the occurrence of nucleate boiling, the release of vapor off of the surfaces of the engine, and the condensation of such vapor within the adjacent bulk coolant.

Yet another advantage of the cooling system of the present invention is the capability, if necessary, to accept all known engine coolants, including 100% water, or water admixed with antifreeze concentrate. Although the preferred method and system of the invention require the coolant to be substantially free of water, there may be times when it becomes necessary to "top-up" or fill the system with a water-based coolant. Accordingly, although water-based coolants are not recommended, their use may be necessary on a temporary and emergency basis when a preferred non-aqueous coolant is unavailable.

The system of the invention may be constructed to accept conventional water-based coolants when this type of situation arises by constructing the components of the system to withstand typical system pressures encountered in water-cooled engines today (e.g., about 14 to 18 psig). By raising the pressure-relief setting of the safety valve 92 of the accumulator to a similar level, a water-based coolant may be used in the system of the invention on an emergency basis, and the operating pressure of the system would in turn be about equal to the pressure-relief setting of the safety valve (typically about 14 to 18 psig). The volume "V" of the second chamber 88 of the accumulator will typically be sufficient to accommodate the thermal expansion of the water-based coolant. Accordingly, during normal engine operation, there should not be any coolant loss through the relief valve 92, nor should there be a need for a vacuum relief valve in order to draw air back into the cooling system, as used in prior art water-based cooling systems.

However, if there is coolant loss through the relief valve and a vacuum is in turn created within the accumulator when the engine cools down, then the ventilation valve 100 can be momentarily opened in the same manner as previously described in order to bring the interior of the accumulator up to ambient pressure. This may be accomplished, for example, by mounting a pressure sensor (not shown), such as a pressure transducer, within the second chamber 88 of the accumulator 78, which may in turn transmit signals to the ECM 102 indicative of the pressure within the chamber. If the pressure reading is either below or above a predetermined pressure range, then the ECM 102 may be programmed to momentarily open the ventilation valve 100 to bring the interior of the accumulator to ambient pressure. Alternatively, the safety valve 92 could take the form of both a pressure-relief and vacuum-relief valve assembly of a type known to those skilled in the pertinent art and adapted to momentarily open in response to the pressure within the second chamber either falling below a lower pressure setting or exceeding an upper pressure setting in order to bring the second chamber to approximately ambient pressure.

It is important to note that under all normal engine operating conditions, the entire engine cooling system, including the accumulator, is maintained in a hermetically-sealed condition, as described above. It is only during abnormal operating conditions, such as in response to a combustion gasket leak or other system failure, or if otherwise necessary to purge gases from the engine cooling system, that the ventilation valve 100 or safety valve 92 is momentarily opened to eliminate either an abnormal over-pressurization or vacuum condition.

The higher pressure setting of the safety valve (14 to 18 psig) will not affect the normal operating pressure of the system when using the preferred substantially water-free coolants, because the safety valve has no functional purpose during normal engine operation, but is provided only for fail-safe operation, as described above. The higher pressure-relief setting would merely raise the pressure at which gases would be vented if a combustion gasket leak or like failure were to occur. During normal engine operation with the preferred coolants, it is the volume "V" of the second chamber 88 of the hermetically-sealed accumulator 78 which establishes the operating pressure at all normal operating conditions of the engine cooling system, not the "fail-safe" setting of the safety valve.

Figures 2, 2A, 2B:
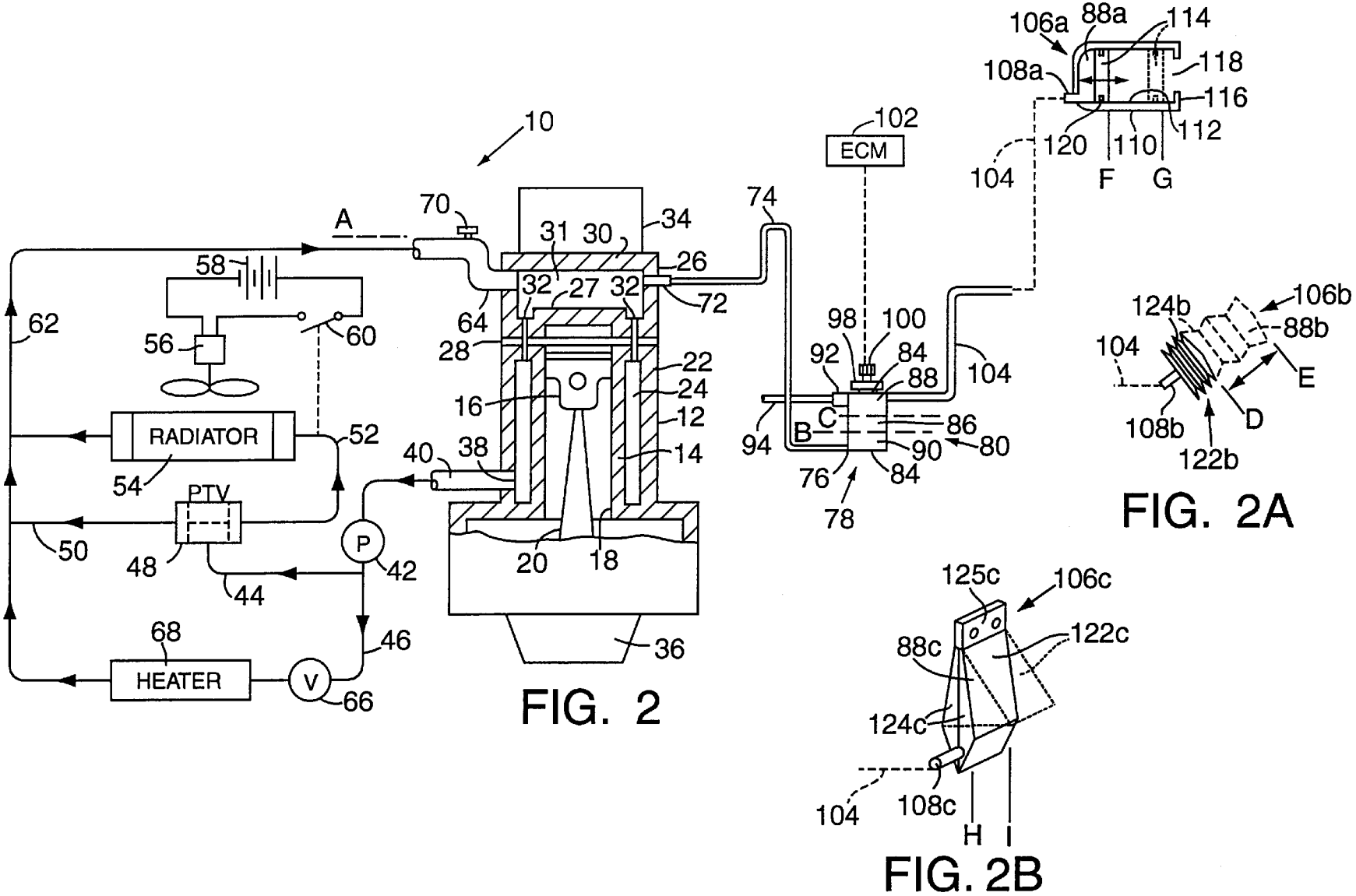
FIG. 2 is a schematic, partial cross-sectional view of another embodiment of an engine cooling system of the present invention wherein the accumulator comprises an expansion housing forming an expandable chamber defining a predetermined volume for receiving at least one of coolant, non-condensable gases and trace amounts of vapor, if any.
FIG. 2A is schematic view of a second embodiment of an expansion housing of the accumulator of the engine cooling system of FIG. 2.
FIG. 2B is a somewhat schematic, perspective view of a third embodiment of an expansion housing of the accumulator of the engine cooling system of FIG. 2.

Turning to FIG. 2, another engine embodying a cooling system of the present invention is indicated generally by the reference numeral 10. The cooling system of the engine 10 is substantially the same as that described above in relation to FIG. 1, and therefore like reference numerals are used to indicate like elements. The cooling system of FIG. 2 differs from the system of FIG. 1 in that the accumulator includes an expandable second chamber (which may be a liquid-free space) which is adapted to expand in response to the flow of at least one of thermally-expanded coolant and gases into the accumulator to thereby maintain the pressure within the accumulator, and thus the static pressure of the engine cooling system, below a predetermined pressure limit during normal engine operation.

As shown in FIG. 2, the accumulator 78 includes an accumulator housing 80 which is similar in construction to the accumulator housing of FIG. 1. However, the housing 80 of FIG. 2 is smaller in size than the housing of FIG. 1 and may not provide a liquid-free space during engine operation, or alternatively, may provide a relatively small liquid-free space 88 defining a volume which is less than approximately 2.0 times the volume of the first chamber 86 (or less than twice the increase in coolant volume due to thermal expansion during engine operation). Otherwise, the first and third chambers 86 and 90, respectively, may be the same as the corresponding chambers described above with reference to FIG. 1.

As shown in FIG. 2, the upper portion of the accumulator housing 80 is coupled in fluid communication with an expansion line 104, which is in turn coupled in fluid communication with an expandable chamber 88*a* of an expansion housing 106*a*. The expansion line 104 is connected to the upper portion of the accumulator housing 80 so that it is in fluid communication with either the liquid-free space 88, or if no such space is provided, then it is in fluid communication with the first chamber 86. As is described in further detail below, the space 88 of the housing 80, the expansion line 104 and the expandable chamber 88*a* together perform the function of the second chamber 88 of the previous embodiment.

The expansion housing 106*a* includes an inlet port 108*a*, and a cylindrical wall section 110 defining a cylindrical bore 112. A movable wall section or piston 114 is slidably received within the bore 112 to define the expandable chamber 88*a* within the bore, and an inwardly-turned lip or flange 116 is formed at one end of the wall section 110 to limit the piston's travel. An aperture 118 is also formed at one end of the housing to expose the exterior side of the piston 114 to ambient pressure, and a suitable gasket, o-ring or like sealing member 120 is seated between the peripheral surface of the piston and the cylindrical wall 110 to maintain a hermetic seal between the expandable chamber 88*a* and the engine's ambient atmosphere.

During engine operation, the thermally-expanded coolant rises from the cold level "B" of the accumulator housing 80 to the hot level "C" (and thus approximately fills the first chamber 86), and any non-condensable gases and trace vapors, if any, flow into the second chamber 88. If the volume of the second chamber 88 of the accumulator housing is insufficient to receive the entire volume of such gases, then they will pass through the expansion line 104 and into the expandable chamber 88*a*. Depending upon the volume of such gases, the piston 114 will move within the expansion housing 106*a* to the right in FIG. 1 from a cold position "F" to a hot position "G" to thereby expand the volume of the chamber 88*a* and accommodate the gases. Because the piston 114 is exposed to the engine's ambient atmosphere through the aperture 118, the piston will move to a point of equilibrium at each operating temperature of the engine so that the pressure on one side of the piston within the chamber 88*a* will be approximately equal to the ambient pressure on the other side of the piston. Accordingly, during normal engine operation, the pressure within the expandable chamber 88*a* will always be approximately equal to the engine's external ambient pressure (about 0.0 psig). In order to achieve this, the combined volume "V" of the second chamber 88 and fully-expanded chamber 88*a* should be at least approximately 2.0 to 3.0 times greater than the increase in volume of coolant due to thermal expansion during engine operation (and approximately defined by the volume of the first chamber 86). When the engine cools down, the coolant level will drop from the hot level "C" to the cold level "B", and the vacuum created by the flow of coolant and gases back toward the engine coolant chambers will draw the piston 114 back toward its cold position "F".

If there is a substantial combustion gasket leak, or if a substantial volume of vapor or gases is otherwise introduced into the coolant chambers, the resultant increase in pressure will likely cause the piston 114 to be moved into engagement with the lip 116. If the pressure within the chambers 88 and 88*a* then exceeds the pressure setting of the safety valve 92 (e.g., about 13 to 15 psig), the valve will open to release any gases and vapors, and in turn maintain the "static" pressure within the cooling system at or below the pressure-relief setting. The term "static" or "base" pressure refers to the pressure caused by thermal expansion of the coolant, as opposed to pressure increases caused by operation of the pump and due, for example, to flow restrictions within the coolant system. Accordingly, the static pressure during engine operation is approximately equal to the pressure within the engine cooling system measured immediately upon engine shut down (by measuring, for example, the pressure within the second chamber of the accumulator) when the temperature of the coolant is approximately equal to the coolant temperature during engine operation.

Both the safety valve 92 and ventilation valve 100 may be the same as the corresponding valves described above with reference to FIG. 1, and the ventilation valve may likewise be controlled by the ECM 102 to periodically purge the chambers 88 and 88*a* of any trapped gases when the coolant temperature is below a predetermined threshold value (e.g., about 32° C. or 90° F.). Although the ventilation valve 100 of FIG. 2 is shown mounted within the fill cap 98, it may equally be located elsewhere provided that such location is upstream of, or prior to the inlet port 108*a* of the respective expansion housing.

Turning to FIG. 2A, another embodiment of the expansion housing is indicated generally by the reference numeral 106*b*, and includes an inlet port 108*b* connected to the expansion line 104, and an expandable wall section 122*b* defining the expandable chamber 88*b* within its hollow interior. The expandable wall section 122*b* includes a plurality of infolded portions or pleats 124*b* defining a bellows-like construction and permitting the wall section to expand and contract in the axial direction of the expansion housing in response to the passage of non-condensable gases and trace vapors, if any, into and out of the expandable chamber 88*b*. The expandable wall section 122*b* is preferably made of a flexible, polymeric material, with sufficient strength to withstand fluid pressures at least equal to the pressure-relief setting of the safety valve 92.

During engine operation, non-condensable gases and trace vapors, if any, may pass through the expansion line 104 and into the expandable chamber 88*b*. The infolded or pleated portions 124*b* of the expandable wall section 122*b* permit the chamber 88*b* to expand in its axial direction from a cold position "D" to a hot position "E" in response to the introduction of the gases and trace vapors into the chamber. Because the external side of the expandable wall 122*b* is exposed to the engine's ambient atmosphere, the chamber 88*b* will always expand to a point of equilibrium at which the pressure within the chamber will be approximately equal to the engine's external ambient pressure (about 0.0 psig). In order to achieve this at all times during normal engine operation, the combined volume "V" of the second chamber 88 and fully-expanded chamber 88*b* should be at least approximately 2.0 to 3.0 times greater than the increase in the volume of coolant due to thermal expansion during engine operation (and approximately defined by the volume of the first chamber 86). When the engine cools down, and the coolant level drops from the hot level "C" to the cold level "B", the vacuum created by the flow of coolant and gases back toward the engine coolant chambers will cause the expandable wall 122*b* to retract inwardly into its cold position "D". As will be recognized by those skilled in the pertinent art, it may be desirable or necessary to mount the bellows-like expansion housing 106*b* in a protective metal or plastic canister or like covering (not shown).

Turning to FIG. 2B, another embodiment of the expansion housing is indicated generally by the reference numeral 106*c* and is in the form of a flexible bag including an inlet port 108*c* connected to the expansion line 104, and an expandable wall section 122*c* defining the expandable chamber 88*c* within its hollow interior. The expandable wall section 122*c* defines at least two pairs of infolded portions or pleats 124*c* located on opposite sides of the bag relative to each other and which permit the wall section to expand outwardly relative to the center of the bag from a cold position "H" to a hot position "I" in response to the passage of non-condensable gases and trace vapors, if any, into the expandable chamber 88*c*, and to permit the expandable wall section to retract inwardly on engine cool down when such gases and trace vapors are drawn back toward the engine's coolant chambers. The expandable wall section 122*c* is preferably made of a flexible, polymeric material, with sufficient strength to withstand fluid pressures at least equal to the pressure-relief setting of the safety valve 92 (e.g., about 13 to 15 psig). These types of materials are readily available and used, for example, in the manufacture of elastomeric fuel cells and liquid storage systems, wherein nylon, carbon or like fibers may be dispersed within the elastomeric material to increase its strength.

One advantage of the bag or bladder-type construction of the expansion housing 106*c* is that it may be easily installed within a vehicle by hanging the bag in any available space without the need for an additional protective covering. As shown in FIG. 2, the expansion housing 106*c* may define a reinforced flange 125*c* along its upper edge, which may in turn define apertures or include mounting hardware (not shown) to hang the bag within the motor vehicle. Accordingly, this embodiment is relatively inexpensive to manufacture and install.

As will be recognized by those skilled in the pertinent art, the accumulator of the present invention, including its expansion housing, may take any of numerous different shapes, configurations and/or sizes. However, in the embodiments of FIGS. 2, 2A and 2B, the accumulator housing 80 should be large enough to at least hold the cold level "B" of coolant (unless the chamber 90 is defined by the vent line 74, as previously described). In this situation, the thermally-expanded coolant will pass through the expansion line 104, and if necessary, into the expandable chamber 88*a*, 88*b* or 88*c*. During engine cool down, the vacuum created by the contracting coolant will draw the liquid coolant and gases from the expandable chamber back into or through the accumulator housing 80. In order to ensure that the entire volume of coolant which enters the expandable chamber is returned to the accumulator housing 80, the inlet port 108*a*, 108*b* or 108*c* should be mounted at a low point of the respective expansion housing, as shown. If, on the other hand, the capacity of the accumulator housing 80 is sufficient to hold the thermally-expanded coolant during normal engine operation, as shown in FIG. 2, then only non-condensable gases, such as air, that may be trapped within the coolant system, will pass into the expandable chamber during normal engine operation. The same gases which are hermetically sealed within the system will be continuously passed back and forth through the expansion line 104 until the system is purged, by for example, operating the ventilation valve 100, as described above. Accordingly, the engine cooling system of FIG. 2 will remain hermetically sealed without exposing the coolant to the engine's ambient atmosphere.

If desired, the accumulator of the invention may be configured so that the expandable chamber is not formed by a separate expansion housing, but rather is formed as part of the accumulator housing (or vice-versa). For example, the accumulator housing 80 of FIG. 2 could be eliminated, and the respective inlet port 108*a*, 108*b* or 108*c* of the expansion housing would be connected to the vent line 74. The thermally-expanded coolant would therefore pass directly from the coolant chambers 24 and 31 into the expandable chamber 88*a*, 88*b* or 88*c*. In this case, the expandable chamber would define a fully-expanded volume at least equal to the volume of the first chamber 86 (i.e., the increase in coolant volume due to thermal expansion during engine operation, which is typically within the range of about 6 to 10% of the cold coolant volume). If this type of accumulator were to take the configuration of either the expansion housing 106*a* or 106*b*, then it may also have to be tilted or otherwise turned on its end to maintain a liquid barrier covering the inlet port 108*a* or 108*b*. in addition, the strength of the expandable wall section would have to be enhanced (particularly if the bellows-like or bladder-like construction were employed) in order to reliably accommodate the increase in its weight and/or internal load. In addition, the fill cap 98, safety valve 92, and ventilation valve 100 would have to be relocated to a high point of the engine or cooling system circuit (e.g., to the location of the air bleed valve 70); however, all other functions would remain the same.

As will also be recognized by those skilled in the pertinent art, the chambers 88 and 88*a*, 88*b* and 88*c* of FIGS. 2 through 2B need not define a liquid-free space, but rather may be substantially entirely filled with liquid coolant in accordance with the present invention. In this situation, the expandable chamber would expand and contract in response to thermal expansion and contraction of the liquid coolant, and thereby maintain the pressure within the accumulator, and thus the static pressure of the engine cooling system at approximately ambient pressure (about 0.0 psig) during normal engine operation.

Figure 3:
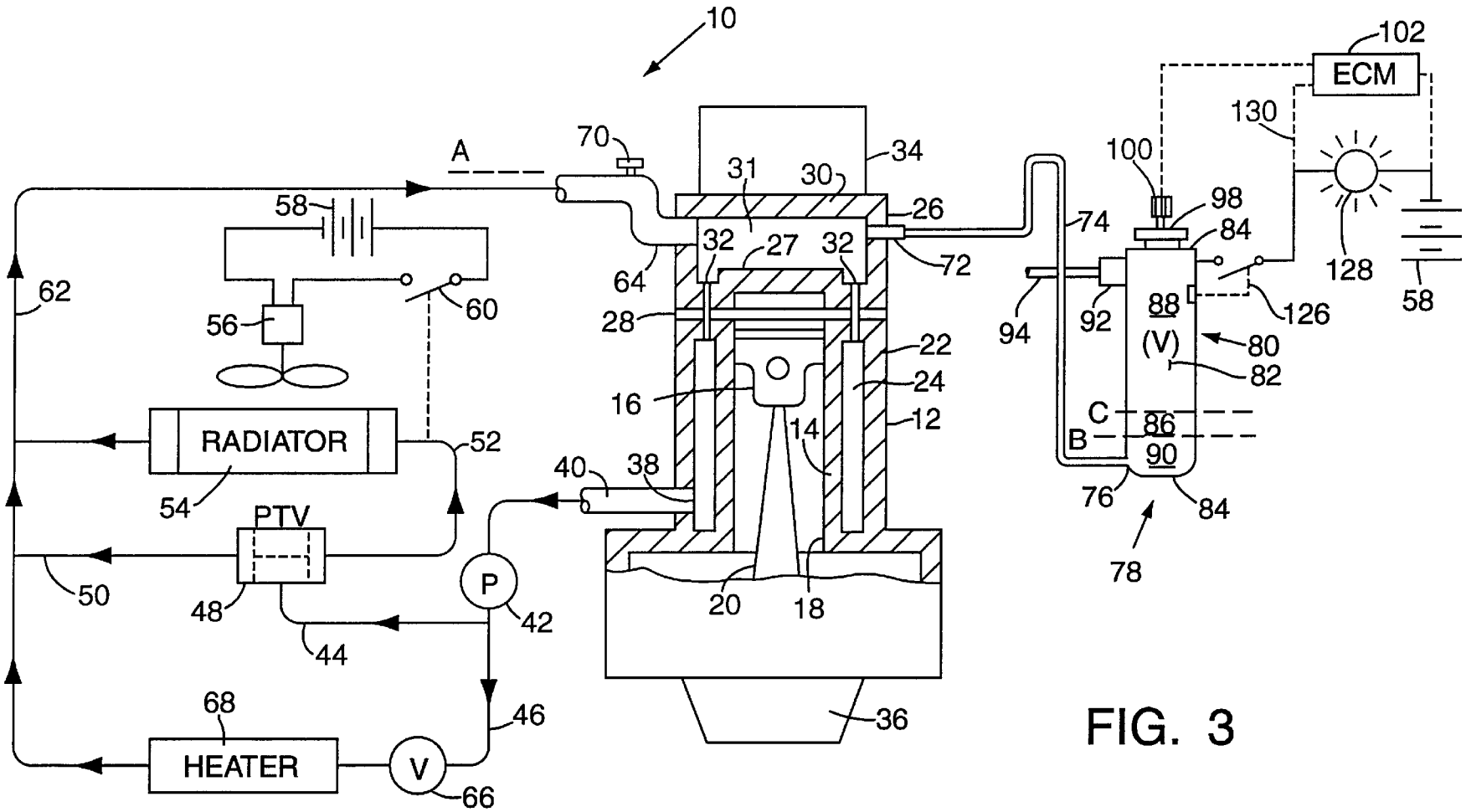
FIG. 3 is a schematic, partial cross-sectional view of another embodiment of an engine cooling system of the invention including a pressure sensor and alarm for alerting an operator of an over-pressurization condition within the accumulator.

In FIG. 3 another engine embodying the cooling system of the present invention is indicated generally by the reference numeral 10. The cooling system of FIG. 3 is substantially the same as the cooling system of FIG. 1, and therefore like reference numerals are used to indicate like elements. The cooling system of FIG. 3 differs from those described above in that it includes means for alerting an operator of an over-pressurization condition within the cooling system, and also includes means for recording the over-pressurization condition and, if desired, means for measuring and recording the degree of over-pressurization.

As shown in FIG. 3, a pressure-sensitive switch 126 is mounted within an upper portion of the accumulator housing 80 and is configured to sense the pressure within the liquid-free space of the second chamber 88. The pressure-sensitive switch 126 is electrically connected to an alarm 128, which may be a visual and/or audible alarm. If it is only desired to alert the operator of an over-pressurization condition, then the switch 126 may be a simple open/close type switch which is normally open, but is adapted to close in response to the pressure within the accumulator exceeding a predetermined threshold value. As shown in FIG. 3, closure of the switch 126 connects the alarm to the vehicle battery 58 (or other power source) to activate the alarm.

Since the normal operating pressure within the accumulator of the invention is a predictable and relatively constant value for each operating temperature of the coolant, the threshold setting of the pressure-sensitive switch 126 may be selected to be slightly higher than the normal operating pressure. For example, if the accumulator 78 is designed to maintain the static pressure at or below approximately 2.0 psig at a full engine load and maximum coolant temperature, then the pressure-sensitive switch 126 would be set to close at about 4.0 psig (approximately 2.0 psig over the predicted static pressure under maximum load conditions). Under normal engine operating conditions (including high engine loads and temperatures), the threshold pressure for the alarm circuit would never be reached. However, if an over-pressurization condition were to occur, due, for example, to a failed head gasket, a crack in the engine block or coolant jacket, or a substantial amount of water in the coolant, then the system pressure would rise above the 4.0 psig threshold, and the alarm would be activated. The alarm 128 may consist of an lamp or other visual indicator located, for example, on the engine control panel, which would alert the operator to "check engine" or "check cooling system". The alarm may also include an audible signal, if desired. In more sophisticated systems, the alarm may consist of a more detailed visual or audible message, explaining more specifically the nature of the problem.

One advantage of this type of alarm circuit in comparison to prior art cooling systems, is that an operator may be promptly alerted to a mechanical failure, and sufficiently in advance of a major failure so as to minimize the magnitude and cost of repairs. For example, head gasket failures (or metal cracks) usually start as small leaks which pass only small amounts of combustion gases into the engine cooling system. In prior art cooling systems, such minor leaks cause a gradual rise in system pressure as the combustion gases displace the coolant, until the pressure within the system reaches the pressure setting of the radiator cap (or system pressure limit), and the cap in turn purges the gases into the engine's ambient atmosphere. This type of cycle may be repeated numerous times, without any knowledge on the part of the operator, until the failure becomes so severe that large volumes of combustion gases are violently released through the radiator cap. At that point, with these types of severe failures in prior art systems, a major fraction of engine coolant is typically lost and a complete cooling system failure ensues. In the present system, on the other hand, the operator would be alerted to the defective condition long before any such severe failure were to occur.

The system of the invention may also include means for recording an over-pressurization condition by electrically connecting the pressure-sensitive switch 126 through a memory circuit 130 to the ECM 102. In this situation, the pressure-sensitive switch 126 may be a simple open/close type switch as described above, or it may be a more sophisticated pressure-sensitive switch or sensor (e.g., a pressure transducer) which is capable of transmitting signals to the ECM indicative of the pressure within the accumulator 78. If it is only desired to record the occurrence of an over-pressurization condition, then the simple switch as described above would suffice. In the operation of this type of system, closure of the switch 126 would transmit a signal to the ECM 102. The ECM would in turn store this event in its memory as a "check engine" code, and the selected code would be identifiable as an over-pressurization condition which could later be retrieved during engine servicing. In addition, rather than automatically actuate the alarm 128 with closure of the switch 126, the ECM 102 could likewise be programmed to actuate the alarm and alert the operator of the over-pressurization condition in any of numerous ways known to those skilled in the pertinent art.

If it further desired to store quantified data pertaining to each over-pressurization condition (e.g., the exact psig, duration, number of occurrences, etc.), then the switch 126 is a more sophisticated pressure sensor which transmits data to the ECM indicative of the exact pressure level, and the ECM is programmed to in turn record and transmit this data in any of numerous desired formats. One advantage of this type of feature is that the quantified data could be used by the engine manufacturer to determine warranty issues related to cooling system failures. For example, such data would be useful in determining whether the preferred coolant had been replaced with an alternate coolant (e.g., an EGW mixture, or 100% water) and how long the alternate coolant was used in the cooling system.

As shown in FIG. 3, the ECM 102 in this system is also preferably connected to the ventilation valve 100 to periodically purge any trapped gases from the coolant chambers, as described previously. In addition, although the means for sensing and/or recording over-pressurization is illustrated in FIG. 3 in connection with an accumulator of the type illustrated in FIG. 1, they may equally be employed with any other accumulator of the present invention.

Figure 4:
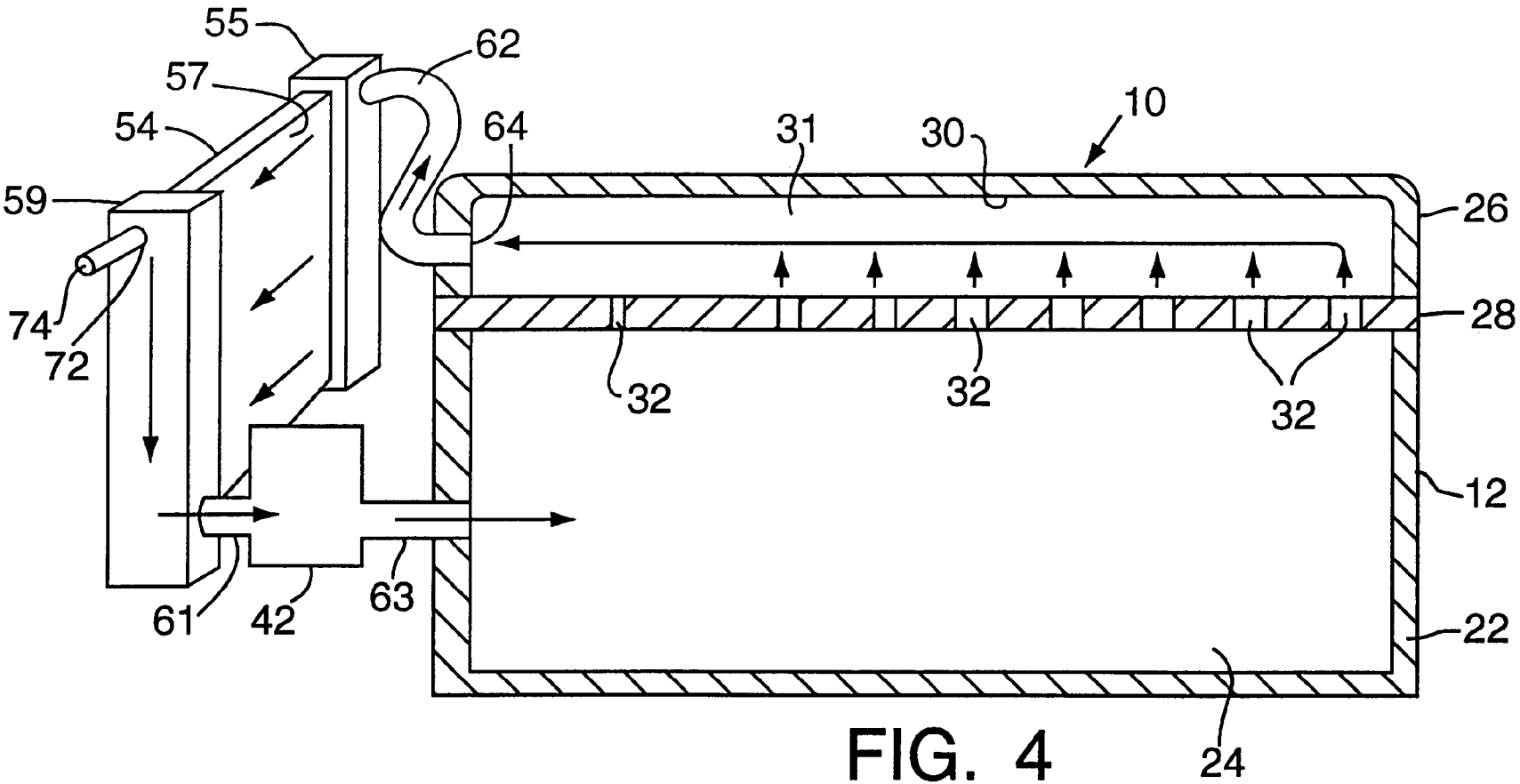
FIG. 4 is a schematic cross-sectional view of an engine configured to pump the coolant in a conventional-flow direction, as opposed to a reverse-flow direction, and is provided for purposes of explaining how this type of engine is modified or configured to incorporate a cooling system of the invention.

In FIG. 4, the cooling system of the engine 10 is configured to pump the coolant in a "conventional-flow" direction, as opposed to the "reverse-flow" direction described above with reference to FIGS. 1 through 3. The engine 10 of FIG. 4 is the same in many respects as those described above, and therefore like reference numerals are used to indicate like elements. As indicated by the arrows in FIG. 4, in a "conventional flow" system the coolant flows upwardly through the engine 10 in the direction from the engine block coolant chamber 24 into the head coolant chamber 31.

More specifically, as shown in FIG. 4, the radiator 54 includes an inlet tank 55, a liquid-to-air heat exchange core 57 including a plurality of core tubes for receiving hot coolant from the inlet tank, and an outlet tank 59 for receiving the lower temperature coolant after passage through the core. The outlet tank 59 is connected to a pump inlet line 61, which is in turn connected to the pump 42 for pumping the lower temperature coolant through an engine input line 63 and back into the block coolant chamber 24. As indicated by the arrows in FIG. 4, the coolant in the block coolant chamber 24 flows upwardly through the coolant ports 32 of the head gasket 28, and into the head coolant chamber 31 of the head 26. After passing through the coolant chambers 24 and 31, the hot coolant is discharged through an outlet port 64, which is in turn connected to an engine output line 62 for discharging the hot coolant into the relatively higher pressure inlet tank 55 of the radiator 54. After passage through the heat-exchange core 54, the lower temperature coolant is received within the lower-pressure outlet tank 59, where the lower temperature and lower pressure coolant is received in the pump inlet line 61, and in turn pumped back through the engine coolant chambers. As described in further detail in U.S. Pat. No. 5,031,579, the plurality of coolant ports 32 are preferably progressively staged as shown in order to minimize the effect of the coolant outlet port 64 being located in relative close proximity to the coolant inlet line 63, and to thereby avoid the problem of liquid coolant being unevenly distributed throughout the coolant chambers.

In mounting the cooling system of the present invention to this type of "conventional-flow" engine, the vent port 72 is located within a relatively lower-pressure area of the coolant flow circuit, such as within the upper portion of the outlet tank 59 of the radiator 54, as shown in FIG. 4, in order to couple the accumulator (not shown) in fluid communication with the engine coolant chambers forming a part of the coolant flow circuit. The vent line 74 is connected to the vent port 72, and the accumulator housing 80 (not shown) is connected to the vent line and mounted in the same manner as described above with reference to FIGS. 1 through 3. Alternatively, the vent port 72 may be located within the relatively lower-pressure pump inlet line 61, or within the inlet port of the pump 42. However, the vent port 72 is preferably located within an elevated area of the engine, such as in the upper portion of the radiator outlet tank 59 as shown, in order to ensure that any trapped gases are discharged into the accumulator, as described previously. In addition, because the vent port 72 is connected to the low-pressure side of the cooling system, the coolant will not be forced through the vent port and into the accumulator by action of the pump.

Figure 5:
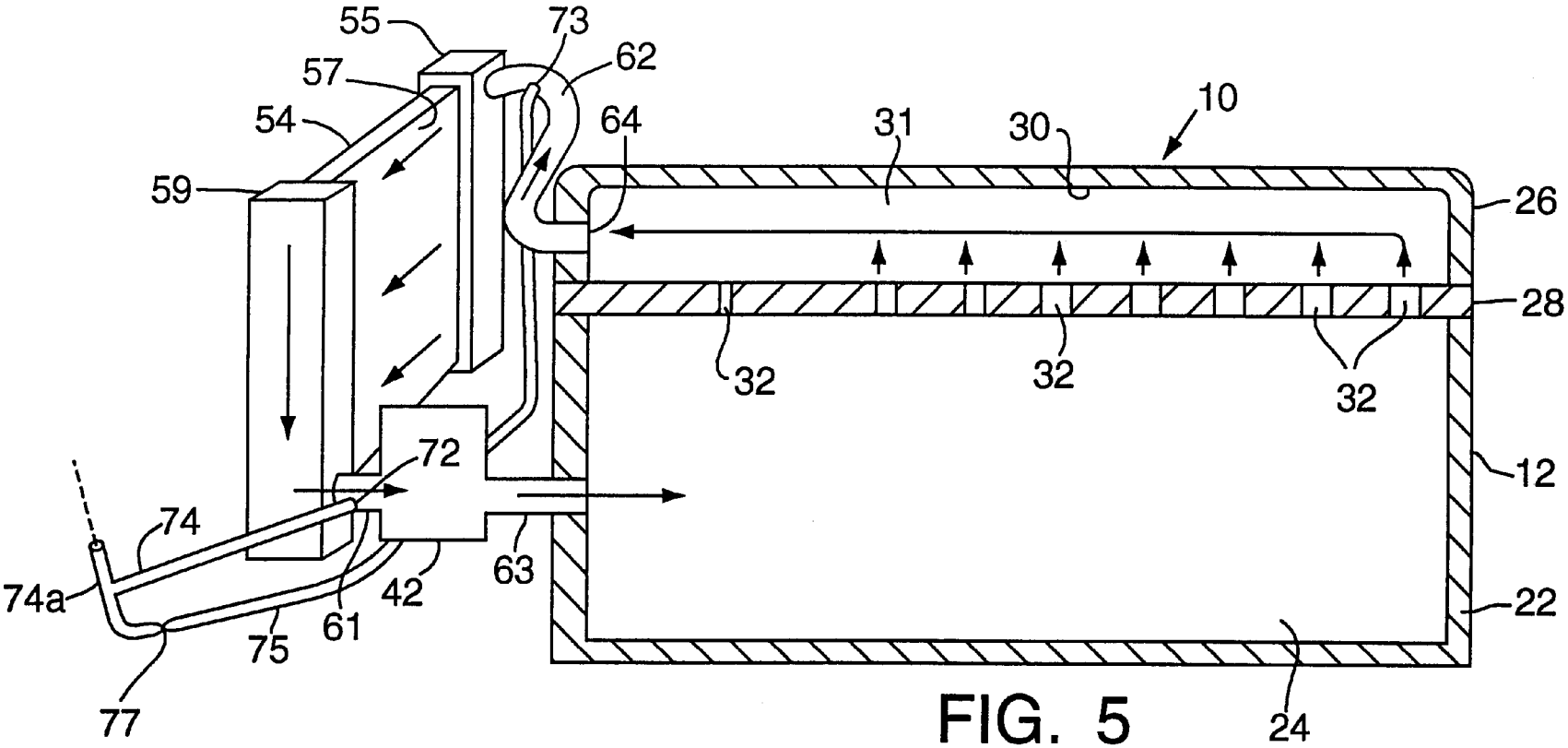
FIG. 5 is a schematic cross-sectional view of another embodiment of a cooling system of the invention configured to pump the coolant in a conventional-flow direction.

Turning to FIG. 5, another engine embodying a cooling system of the present invention is indicated generally by the reference numeral 10. The cooling system of the engine 10 is configured to pump the coolant in the "conventional-flow" direction like the system described above in relation to FIG. 4, and therefore like reference numerals are used to indicate like elements.

A primary difference of the engine 10 of FIG. 5 is that the vent port 72, which couples the accumulator in fluid communication with the engine coolant chambers, is connected to the relatively lower-pressure inlet line 61 of the coolant pump 42, and is thus located within a lower region of the coolant flow circuit and engine. Accordingly, in order to de-gas the higher elevations of the radiator 54 and of the coolant chambers 24 and 31, a de-gassing outlet port 73 is connected to the upper hose 62 extending between the head coolant chamber 31 and radiator 54, and a de-gassing line 75 is connected to the de-gassing port 73 to receive non-condensable gases and trace vapors, if any, passing through the upper hose. The other end of the de-gassing line 75 is connected to one leg of a junction tee, and the other two legs of the tee are connected to the vent line 74 and a second vent line 74*a*, respectively. The second vent line 74*a* is in turn connected to the accumulator housing (not shown), which may be the same as any of those previously described. Accordingly, this embodiment of the invention includes a de-gassing and vent line assembly comprising the de-gassing line 75, the vent line 74, and the second vent line 74*a*, which together perform the function of the single vent line of the previously-described embodiments. As indicated schematically in FIG. 5, the de-gassing line 75 includes a flow restriction 77 defining a reduced internal diameter, typically within the range of about 1.6 through 2.4 mm (0.060 through 0.090 inch) for constricting the coolant flow passageway, and thereby establishing a maximum coolant flow rate through the de-gassing and vent lines.

In the operation of the engine 10 of FIG. 5, any entrapped non-condensable gases and trace vapors, if present, which accumulate in the upper elevations of the cooling system, will pass through the vent port 73 and into the de-gassing line 75 with a small volume of liquid coolant. The coolant flow rate through the de-gassing line 75 is established by the flow restrictor 77, and any such coolant flows from the de-gassing line, through the junction tee and vent line 74, and into the inlet line 61 of the pump 42. Although the coolant flowing through the de-gassing line 75 by-passes the radiator 54, the volume of such coolant is extremely small and thus does not have a significant debilitating effect on the cooling performance of the radiator 54 or engine cooling system. The non-condensable gases and trace vapors, if any, will break away from the minor fraction of coolant continually flowing from the degassing line 75 and into the vent line 74, and will in turn pass upwardly through the second vent line 74*a* and into the accumulator housing. Only liquid coolant, free of any gases, will pass through the vent line 74, pump 42 and back into the engine coolant chambers, thereby exhausting substantially all gases into the accumulator.

Although the radiator 54 of FIG. 5 is schematically illustrated as a "cross-flow" radiator, the same vent line assembly may be employed with a "down-flow" radiator. In a down-flow radiator, the higher-pressure inlet tank is located on the top of the radiator, and typically extends horizontally adjacent to the radiator core, and the lower-pressure outlet tank is located at the bottom of the radiator core so that the coolant flows from the inlet tank downwardly through the core and into the outlet tank. In this type of system configured to pump the coolant in a "conventional-flow" direction (as opposed to "reverse-flow"), the vent port 72 is preferably located in one of the following relatively low-pressure locations on the draw side of the pump 42 in order to couple the accumulator in fluid communication with the engine coolant chambers: within the outlet (or bottom) tank of the radiator, within the pump inlet line, or within the inlet port of the pump. In addition, if the system does not include a de-gassing outlet port 73 and de-gassing line 75 as illustrated in FIG. 5, then a purge valve mounted in an upper region of the cooling system, such as the air-bleed valve 70 of FIG. 1, may be used instead to periodically purge and thereby degas the cooling system.

Figure 6:
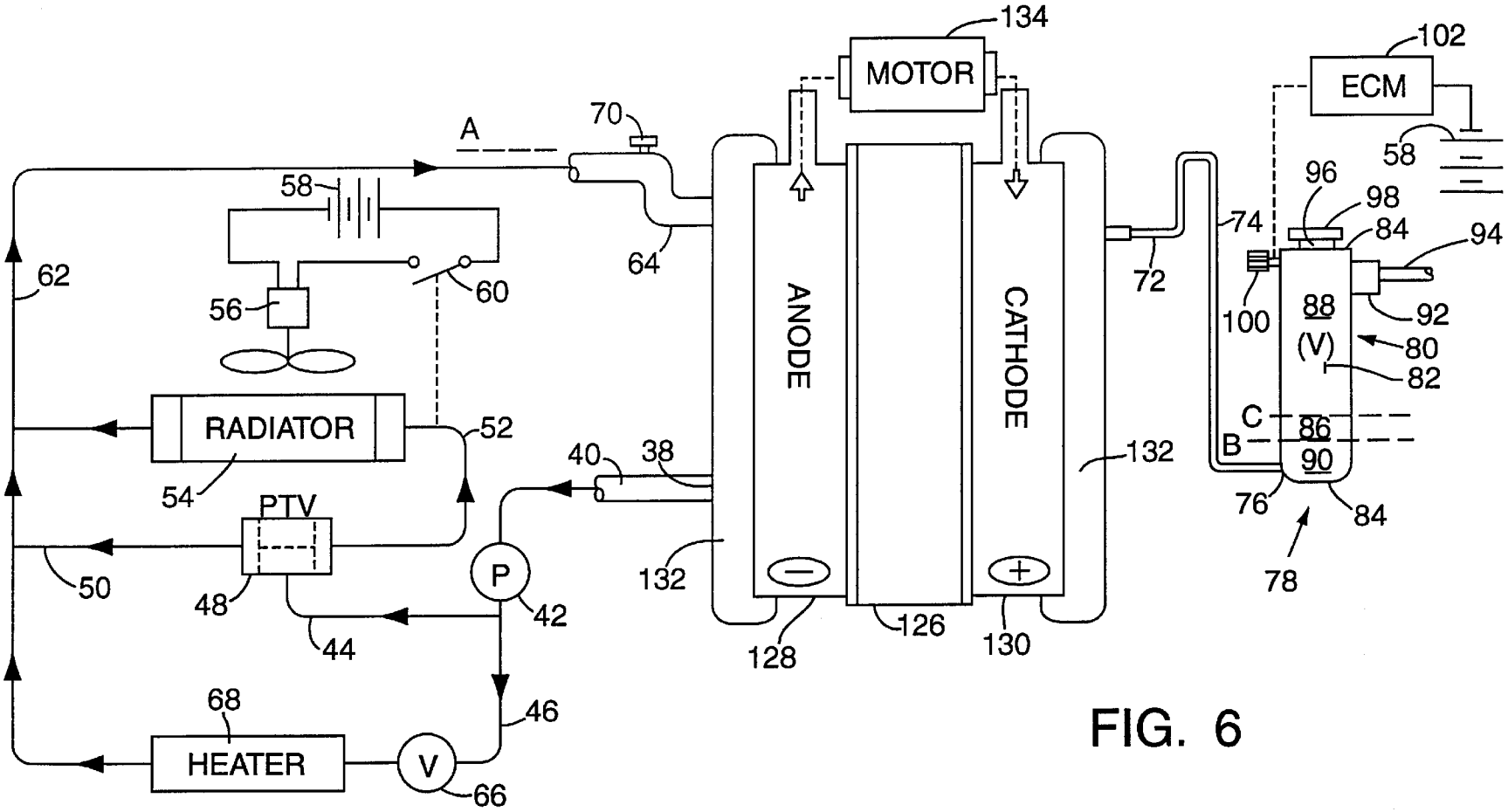
FIG. 6 is a schematic, partial cross-sectional view of another embodiment of an engine cooling system of the present invention wherein the engine is a fuel cell.

Turning to FIG. 6, another engine embodying a cooling system of the present invention is indicated generally by the reference numeral 10. The primary difference of the engine 10 in comparison to the engine's illustrated above, is that the engine 10 is not an internal combustion engine, but rather is another type of engine for generating electrical power which is typically referred to as a "fuel cell". The cooling system of the engine or fuel cell 10 is essentially the same as that described above with reference to FIGS. 1 through 5, and therefore like reference numerals are used to indicate like elements.

The engine of FIG. 6 is more specifically identified as a "proton exchange membrane fuel cell", and generates electricity by combining air and any of various hydrogen-enriched fuels, such as liquid hydrogen, methanol, ethanol and petroleum. If liquid hydrogen is used, then the only emission from the engine is typically water. This type of engine is therefore effectively a "gas battery" which is capable of providing approximately the same power density (or equivalent packaging) as a comparable internal combustion engine.

As shown in FIG. 6, the engine 10 includes a membrane catalyst 126, a negative anode cell 128 mounted on one side of the membrane, and a positive cathode cell 130 mounted on the opposite side of the membrane. A hermetically-sealed engine coolant chamber 132 surrounds the anode and cathode cells 128 and 130, respectively, and is coupled in fluid communication with the other components of the engine cooling system in the same manner as the engine coolant chambers described above for receiving a liquid coolant to transfer heat away from the heat-rejecting components of the engine. An electric motor 134 is electrically connected between the anode cell 128 and cathode cell 130 for receiving the flow of electrons between the two cells, and to in turn convert the electric current into mechanical force or motion.

In the operation of the fuel cell 10, the hydrogen-enriched fuel is introduced into the negative anode cell 128, and the membrane catalyst 126 functions to permit only the protons of the fuel to flow through the membrane to the positive anode cell 130. The membrane catalyst 126 is configured in a manner known to those skilled in the pertinent art so that it causes the electrons of the fuel to split-off from the protons, and to in turn pass through a separate electric circuit to the cathode. Accordingly, the electron flow is generated by the fuel cell for producing energy for work. In the embodiment of the present invention illustrated, the electric current generated by the fuel cell is used to drive the electric motor 134. As will be recognized by those skilled in the pertinent, however, the electric current generated by the fuel cell may be used for numerous other purposes.

When the electrons reach the cathode cell 130, the hydrogen molecules react with oxygen in the air and produce water, which is the primary emission of the engine. A significant amount of heat may be generated when the electrons are split off in the anode cell 128, and when the hydrogen molecules react with air to produce water in the cathode cell 130. The coolant may therefore be the same type of coolant as described above, and may be pumped through the coolant chamber 132 in the same manner as the coolant described above in connection with any of the previous embodiments.

Accordingly, the coolant preferably fills the coolant chamber 132, and during "reverse-flow" operation of the engine, as indicated schematically in FIG. 6, the pump 42 draws the hot coolant through the outlet port 38 and conduit 40. The coolant then passes through the heater 68 and/or radiator 54 in the same manner as described above, and in turn passes through the upper conduit 62 and inlet port 64 and into the upper region of the coolant chamber 132. As also indicated in FIG. 6, the vent port 72 is connected to the upper region of the coolant chamber 132, and the accumulator 78 functions in the same manner as described above in connection with either of FIGS. 1 or 3. If desired, the accumulator may likewise be configured in accordance with the embodiment of FIG. 2 and would function in the same manner as previously described.

If, on the other hand, the coolant is pumped in a "conventional-flow" direction, then the vent port of the accumulator may be located and connected to the other components of the cooling system in the same manner as previously described in connection with either of FIGS. 4 or 5.

Accordingly, although the accumulator 78 of FIG. 6 is configured in the same manner as described above in connection with the embodiment of FIG. 1, it may equally be configured in accordance with any of the other above-described embodiments, and may include any of the additional features and operate in essentially the same manner as each of the above-described embodiments.

As will be recognized by those skilled in the pertinent art, numerous modifications may be made to the above-described and other embodiments of the present invention, without departing from its scope as defined in the appended claims. Accordingly, this detailed description of preferred embodiments is to be taken in an illustrative, as opposed to a limiting sense.

I claim:

1. An engine cooling system, comprising:

at least one engine coolant chamber formed adjacent to heat-rejecting components of the engine and hermetically sealed to prevent exposure of coolant within the chamber to the engine's ambient atmosphere;

liquid coolant received within the at least one engine coolant chamber and defining a first volume prior to engine operation and a second volume greater than the first volume due to thermal expansion of the coolant during engine operation;

a coolant pump coupled in fluid communication with the engine coolant chamber for pumping the liquid coolant through the coolant chamber and transferring heat away from the heat-rejecting components of the engine; and an accumulator defining at least one hermetically-sealed chamber coupled in fluid communication with the at least one engine coolant chamber and receiving at least one of thermally-expanded coolant and gas from the at least one engine coolant chamber, wherein the at least one hermetically-sealed chamber defines a volume at least equal to or greater than the difference between the first and second volumes of the liquid coolant, and the accumulator further defines at least one of:

(i) a substantially liquid-free space coupled in fluid communication with the at least one hermetically-sealed chamber for receiving gas, and (ii) a movable wall coupled in fluid communication on one side with the at least one hermetically-sealed chamber and coupled in fluid communication on another side with ambient atmosphere and movable in response to the flow of at least one of thermally-expanded coolant and gas into the hermetically-sealed chamber, to thereby maintain the pressure within the at least one chamber of the accumulator within a predetermined pressure limit during engine operation.

2. An engine cooling system as defined in claim 1, wherein the accumulator includes (i) a first hermetically-sealed chamber coupled in fluid communication with the at least one engine coolant chamber and defining said volume at least equal to or greater than the difference between the first and second volumes of the liquid coolant for receiving thermally-expanded coolant during engine operation, and (ii) a second hermetically-sealed chamber forming the substantially liquid-free space coupled in fluid communication with the first chamber for receiving gas and defining a second volume selected to maintain the pressure in the second chamber within the predetermined pressure limit during engine operation.

3. An engine cooling system as defined in claim 2, wherein the accumulator further defines a third hermetically-sealed chamber coupled in fluid communication between the at least one engine coolant chamber and the first chamber and containing liquid coolant forming a liquid barrier between the second chamber and engine coolant chamber.

4. An engine cooling system as defined in claim 3, wherein the accumulator includes a vent line coupled in fluid communication between the at least one engine coolant chamber and the first and second chambers, and the vent line forms at least part of the third chamber containing the liquid coolant forming the liquid barrier between the second chamber and coolant chamber.

5. An engine cooling system as defined in claim 2, wherein the second volume of the second hermetically-sealed chamber is within the range of approximately 2.0 through 3.0 times greater than said volume of the first hermetically-sealed chamber.

6. An engine cooling system as defined in claim 2, wherein the accumulator includes at least one accumulator housing forming a hollow interior and defining the first chamber within a lower portion of the hollow interior and the second chamber within another portion of the hollow interior adjacent to and above the first chamber.

7. An engine cooling system as defined in claim 2, wherein the second chamber is expandable in response to the receipt of at least one of thermally-expanded coolant and gas to define the second volume.

8. An engine cooling system as defined in claim 1, further comprising means for pumping coolant through the at least one engine coolant chamber and condensing substantially all coolant vaporized by the heat-rejecting components of the engine with the liquid coolant.

9. An engine cooling system as defined in claim 8, wherein the liquid coolant is a substantially anhydrous, boilable liquid coolant having a saturation temperature higher than that of water.

10. An engine cooling system as defined in claim 1, wherein the movable wall of the accumulator is defined by an expandable wall section forming at least a portion of the at least one chamber and being expandable in at least one direction in response to the introduction of at least one of coolant and gas into the chamber to define the volume of the chamber.

11. An engine cooling system as defined in claim 1, wherein the movable wall section is slidably received within the at least one chamber and movable to expand the volume of the chamber in response to the flow of at least one of thermally-expanded coolant and gas into the accumulator.

12. An engine cooling system as defined in claim 1, further comprising means for generating a warning signal in response to the pressure within the at least one accumulator chamber exceeding a predetermined threshold value.

13. An engine cooling system as defined in claim 1, wherein the predetermined pressure limit is within the range of 1 through 5 psig.

14. An engine cooling system as defined in claim 1, wherein the volume of the at least one accumulator chamber is selected to maintain the static system pressure of the engine cooling system within the predetermined pressure limit during engine operation.

15. An engine cooling system as defined in claim 1, further comprising:

a pump defining an inlet side and an outlet side, wherein the outlet side is coupled in fluid communication with the at least one engine coolant chamber for pumping coolant into the engine coolant chamber; and a radiator including a plurality of core tubes defining an inlet side coupled in fluid communication with the at least one engine coolant chamber for receiving coolant therefrom, and an outlet side coupled in fluid communication with the pump for supplying the coolant received from the engine coolant chamber to the pump, wherein the accumulator is connected in fluid communication between the outlet side of the core tubes and the inlet side of the pump.

16. An engine cooling system as defined in claim 15, further comprising a de-gassing line coupled in fluid communication on one end between the at least one coolant chamber and the inlet side of the core tubes for receiving gas passing between the coolant chamber and radiator, and coupled in fluid communication on another end to the first chamber of the accumulator for introducing such gas into the accumulator.

17. An engine cooling system as defined in claim 16, wherein the de-gassing line defines a constricted portion for reducing the flow rate of any coolant flowing through the degassing line, and the constricted portion is in turn coupled in fluid communication with the inlet side of the pump for directing such coolant to the pump.

18. An engine cooling system as defined in claim 1, further including means for directing the flow of coolant in the direction from a higher region of the at least one engine coolant chamber into a lower region of the at least one engine coolant chamber, and wherein the accumulator is connected in fluid communication with the higher region of the at least one engine coolant chamber.

19. An engine cooling system as defined in claim 1, wherein the at least one engine coolant chamber forms a coolant circuit, and the at least one accumulator chamber is coupled in fluid communication with a relatively low-pressure area of the coolant circuit.

20. An engine cooling system, comprising:

at least one engine coolant chamber formed adjacent to heat-rejecting components of the engine and hermetically sealed to prevent exposure of coolant within the chamber to the engine's ambient atmosphere;

a coolant pump coupled in fluid communication with the engine coolant chamber for pumping a liquid coolant through the coolant chamber and transferring heat away from the heat-rejecting components of the engine;

an accumulator including (i) a first hermetically-sealed chamber coupled in fluid communication with the at least one engine coolant chamber and defining a first volume for receiving thermally-expanded coolant during engine operation, and (ii) a second hermetically-sealed chamber coupled in fluid communication with the first chamber for receiving gas and defining a second volume selected to maintain the pressure in the second chamber within a predetermined pressure limit during engine operation;

a ventilation valve coupled in fluid communication with the second chamber of the accumulator for purging gas from the second chamber; and an electronic control unit connected to the valve for opening and closing the valve, and configured to momentarily open the valve when the coolant temperature is below a threshold value to purge any excess gas from the second chamber.

21. An engine cooling system as defined in claim 1, further comprising a pressure-relief valve coupled in fluid communication with the at least one accumulator chamber, and adapted to release gas from the at least one accumulator chamber in response to the pressure in said chamber exceeding a maximum cooling system pressure value.

22. An engine cooling system, comprising:

at least one engine coolant chamber formed adjacent to heat-rejecting components of the engine and hermetically sealed to prevent exposure of coolant within the chamber to the engine's ambient atmosphere;

liquid coolant received within the at least one engine coolant chamber and defining a first volume prior to engine operation and a second volume greater than the first volume due to thermal expansion of the coolant during engine operation;

means for pumping the liquid coolant through the engine coolant chamber and condensing substantially all coolant vaporized by heat-rejecting components of the engine with the liquid coolant; and means coupled in fluid communication with the at least one engine coolant chamber for accumulating at least one of thermally-expanded coolant and gas from the at least one engine coolant chamber, and including:

at least one hermetically-sealed chamber defining a volume at least equal to or greater than the difference between the first and second volumes of the liquid coolant, and at least one of:

(i) a substantially liquid-free space coupled in fluid communication with the at least one hermetically-sealed chamber for receiving gas, and (ii) a movable surface coupled in fluid communication on one side with the at least one hermetically-sealed chamber and coupled in fluid communication on another side with ambient atmosphere, and movable in response to the flow of at least one of thermally-expanded coolant and gas into the hermetically-sealed chamber, for maintaining the pressure of such thermally-expanded coolant and gas below a predetermined pressure limit during engine operation, said means being hermetically sealed to prevent exposure of the coolant to the engine's ambient atmosphere.

23. An engine cooling system as defined in claim 22, wherein the accumulating means defines a first chamber defining said volume at least equal to or greater than the difference between the first and second volumes of the liquid coolant for receiving the thermally-expanded coolant, and a second chamber defining the substantially liquid-free space coupled in fluid communication with the first chamber for receiving gas and defining a second volume selected to maintain the pressure of the second chamber below the predetermined pressure limit during engine operation.

24. An engine cooling system as defined in claim 23, wherein the second volume is at least approximately 2.0 times greater than the difference between the first and second volumes of the liquid coolant.

25. An engine cooling system as defined in claim 22, wherein the movable surface of the accumulating means is formed by an expandable wall section defining at least one hermetically-sealed chamber and being expandable in response to the introduction of at least one of coolant and gas into the chamber to define a volume selected to maintain the pressure within the at least one chamber below a predetermined pressure limit, and being collapsible in response to the removal of at least one of coolant and gas from the at least one chamber.

26. An engine cooling system as defined in claim 22, wherein the movable surface of the accumulating means is formed by a movable wall section slidably received within a hermetically-sealed chamber and movable to expand the volume of the chamber in response to the flow of at least one of thermally-expanded coolant and gas into the chamber, and movable to reduce the volume of the chamber in response to the flow of at least one of coolant and gas out of the chamber.

27. An engine cooling system as defined in claim 22, wherein the coolant is a substantially anhydrous, boilable liquid coolant having a saturation temperature higher than that of water.

28. An engine cooling system as defined in claim 22, further comprising means for at least one of visually and audibly indicating if the pressure within the accumulating means exceeds a predetermined pressure level.

29. An engine cooling system as defined in claim 22, further comprising means for sensing the pressure within the accumulating means and generating signals indicative thereof.

30. An engine cooling system as defined in claim 29, further comprising means responsive to the sensing means for recording the pressure level within the accumulating means.

31. An engine cooling system as defined in claim 22, wherein the at least one engine coolant chamber is part of a coolant flow circuit, and the accumulating means is coupled in fluid communication with the at least one engine coolant chamber at a relatively low-pressure location within the coolant flow circuit.

32. A method of cooling an engine having at least one coolant chamber formed adjacent to heat-rejecting components of the engine and hermetically sealed to prevent exposure of the coolant within the coolant chamber to the engine's ambient atmosphere, comprising the steps of:

pumping a liquid coolant through the at least one coolant chamber and condensing substantially all of the liquid coolant vaporized by the heat-rejecting components of the engine with the liquid coolant in the at least one coolant chamber;

accumulating thermally-expanded coolant in a hermetically-sealed accumulating chamber coupled in fluid communication with the at least one coolant chamber; and maintaining a volume within the accumulating chamber for receiving the thermally-expanded coolant which is at least equal to or greater than an increase in coolant volume due to thermal expansion during engine operation, and further comprising at least one of the following steps:

(i) exposing the coolant in the hermetically-sealed accumulating chamber to a substantially liquid-free space for receiving gas, and (ii) exposing the coolant in the hermetically-sealed accumulating chamber to a movable wall, and permitting the wall to move with expansion and contraction of the liquid coolant along an unobstructed path throughout engine operation, to thereby prevent the pressure within the accumulating chamber from exceeding a predetermined pressure limit during engine operation.

33. A method as defined in claim 32, further comprising the step of directing the coolant to flow in the direction from a higher region to a lower region of the engine, and accumulating the thermally-expanded coolant and any gas from a location within the higher region of the engine.

34. A method as defined in claim 32, wherein the at least one coolant chamber is part of a coolant flow circuit, and further comprising the step of drawing the thermally-expanded coolant and any gas from a relatively low-pressure location within the coolant flow circuit.

35. An engine cooling system as defined in claim 22, further comprising means for distributing the pumped coolant within the engine coolant chamber for condensing within the liquid coolant substantially all coolant vaporized by heat-rejecting components of the engine.

36. A method as defined in claim 32, further comprising the steps of exposing a side of the movable wall opposite the coolant to the engine's ambient atmosphere and, in turn, maintaining the pressure within the accumulating chamber approximately equal to ambient atmospheric pressure.

* * * * *